US008961340B2

(12) United States Patent
Boatwright et al.

(10) Patent No.: US 8,961,340 B2
(45) Date of Patent: Feb. 24, 2015

(54) COMPRESSION COLLAR APPARATUS

(76) Inventors: Ryan Lee Boatwright, Thornton, CO (US); Peter Stepanek, Lomnice (CZ); Jason Labonte, Denver, CO (US); Logan Nahmias, Boulder, CO (US); Matt Masters, Denver, CO (US)

( * ) Notice: Subject to any disclaimer, the term of this patent is extended or adjusted under 35 U.S.C. 154(b) by 89 days.

(21) Appl. No.: 13/560,860

(22) Filed: Jul. 27, 2012

(65) Prior Publication Data

US 2013/0196800 A1 Aug. 1, 2013

Related U.S. Application Data

(60) Provisional application No. 61/574,132, filed on Jul. 28, 2011.

(51) Int. Cl.
*A63B 59/06* (2006.01)
*A63B 59/00* (2006.01)

(52) U.S. Cl.
CPC ..... *A63B 59/0044* (2013.01); *A63B 59/06* (2013.01); *A63B 59/0029* (2013.01); *A63B 59/0074* (2013.01)
USPC ..... 473/568; 473/457; 248/74.1; 248/316.5

(58) Field of Classification Search
USPC ..... 473/457, 519, 520, 564–568; 269/268, 269/270, 287, 294; 285/312; 24/271, 273; 248/56, 74.1, 74.4, 273, 316.5
See application file for complete search history.

(56) References Cited

U.S. PATENT DOCUMENTS 1,441,154 A * 1/1923 Johnson ..... 24/20 R
2,091,458 A * 8/1937 Sleight ..... 16/421
3,469,839 A 9/1969 Pietronuto et al.
3,913,187 A * 10/1975 Okuda ..... 24/484
4,183,120 A * 1/1980 Thorne ..... 24/16 R
4,840,345 A * 6/1989 Neil et al. ..... 248/74.2
5,305,978 A * 4/1994 Current ..... 248/230.4
5,359,866 A * 11/1994 Boddy ..... 70/18
5,624,114 A 4/1997 Kelsey
6,059,675 A * 5/2000 Finn ..... 473/568
6,186,454 B1 * 2/2001 Olsen ..... 248/218.4
6,234,924 B1 5/2001 Washburn, Jr.
6,266,852 B1 * 7/2001 Tai ..... 24/16 PB
7,169,069 B1 1/2007 Dalton et al.
7,261,263 B2 * 8/2007 Baker et al. ..... 248/218.4
7,284,731 B1 * 10/2007 Johnson et al. ..... 248/74.4
7,900,324 B2 * 3/2011 Ginocchio ..... 24/272
8,328,457 B2 * 12/2012 Werth ..... 403/289
D682,963 S * 5/2013 McLeod ..... D21/753

(Continued)

*Primary Examiner* — Mark Graham

(74) *Attorney, Agent, or Firm* — Roger A. Jackson

(57) ABSTRACT

A compression collar apparatus is disposed upon an article providing an axial manual grasping stop upon the article, the apparatus includes a first arcuate element having first proximal and distal portions, the first distal portion including an engagement segment. Also, a second arcuate element having second proximal and distal portions, the first proximal portion and the second proximal portion have a first pivotal connection that enables open and closed states of the first and second arcuate elements. Further, a flexible retention arch beam having states of; free, de-arched, and intermediate, includes beam proximal and distal portions, the beam proximal portion and the second distal portion have a second pivotal connection, in the intermediate state the beam distal portion having an interlocking section that has a variable removable engagement with the engagement segment, resulting in the closed state of the first and second arcuate elements about the article.

14 Claims, 16 Drawing Sheets

(56) References Cited

U.S. PATENT DOCUMENTS

D695,100 S * 12/2013 Whitaker et al. ..... D8/396
2001/0031674 A1 10/2001 McGinnis
2008/0179469 A1* 7/2008 Leone et al. ..... 248/56
2011/0034275 A1* 2/2011 Kim ..... 473/457

* cited by examiner

COMPRESSION COLLAR APPARATUS

RELATED PATENT APPLICATION

This application claims the benefit of U.S. provisional patent application Ser. No. 61/574,132 filed on Jul. 28, 2011 by Ryan Lee Boatwright of Thornton, Colo., US.

TECHNICAL FIELD

The present invention relates generally to an apparatus that circumferentially encases an article with compressive force to be able to axially grip the article, thus providing an axial stop on the article for a selectively axial manual grip on the article by a user. More specifically, the present invention relates to the field of base baseball bat use, in what is termed "choking up" on the baseball bat via placing the players manual grasping of the baseball bat as against the compression collar apparatus to selectively control the baseball bat swinging rotational moment determined from the moment arm distance from the baseball bat centroid or center of gravity to the compression collar apparatus axial position that determines the baseball bat swing force and control.

BACKGROUND OF INVENTION

The practice of gripping a baseball bat at a selected distance from its small or butt knob end portion is termed "choking up", being a common practice among baseball players. The desire for the so-called "choking up" is primarily for having improved swing control that can be obtained with a heavier and broader bat. In essence, when a batter "chokes up" they grip the bat closer to its centroid or center of gravity, when this is done the moment arm distance between with where a batter grips the bat and the centroid of the bat is a smaller distance as compared to if they bat were gripped adjacent to the small or butt knob end of the bat, the end result of this is that due to the shorter distance moment arm the bat swinging force is reduced thus resulting in reduced muscular stress for the batter and facilitating a more controlled swing by the batter. Further, "choking up" helps prevent wrist twisting by the batter as the follow-through near the end of the bat swing has less momentum due to the shorter moment arm distance. A further use of "choking up" for the batter is to effectuate the practice of "bunting" the ball from a pitch, which is a controlled minimal swing contact with the baseball that useful in certain situations to advance the players on the bases. In addition, for articles other than baseball bats, for instance such as an industrial broom handle, or hockey stick, or other like items, a compression collar apparatus can work much the same way and that it provides a selectable axial stop upon the article for the user to grasp against. Further, for the axial stop which also has the benefit of allowing for a less compressive and less fatiguing hand grip by the user, as the user does not have to grip the article as firmly to help prevent axial movement of the article within the user's hands.

Wherein the key difficulties are in making the compression collar apparatus easily removably engagable to the article while the same time providing a secure axial stop upon the article for manual grasping, plus given the wide variance in article sizes for the compression collar apparatus to deal with. The articles come in a wide variety of sizes which may or may not necessarily be circumferentially round meaning they could be rectangular, square, elliptical, semicircular, and the like, thus further in measuring in a dimension perpendicular to an article longitudinal axis, the article can have this dimension varying, in other words the article can have a taper being similar to a frustroconical shape, all of which complicates designing for a secure and easy removable engagement of the compression collar apparatus to the article, while the same time providing a secure axial stop upon the article for a user to place their manual grasping against. Ideally, the compression collar apparatus provides a mechanism to accommodate the customization of the use of the article in providing a selectable gripping point that is optimum for that particular user.

In looking at the prior art in this area, in U.S. Pat. No. 7,169,069 to Dalton, et al., disclosed is an adjustable collar for attachment around a handle such as the handle of a baseball bat. The adjustable collar in Dalton has a rubber-like strip which has a strap affixed to its outer face. The strap in Dalton extends past the rubber strip and has a ring at one end and a free end at the other end. The rubber-like strip in Dalton is pressed against the place on the handle where it is desired to be attached and the free end is passed through the ring and is looped back toward the free end and affixed to the strap by a hook and loop fastener or other removably engagable fastening structure. Thus, Dalton essentially uses a flexible cloth hook and loop fastener to pull the collar tight about the baseball bat, resulting in a somewhat weaker collar compression about the bat that is not necessarily easily removably engagable.

Continuing in the prior art, in looking at U.S. Pat. No. 6,243,924 to Washburn, Jr., disclosed is an artificial bat end device for temporarily adjusting the length of a bat by using an adjustable ring having a thickness sufficient to simulate the butt end of a bat with the ring, also having the capability to conform to the handle of a bat and be forcibly held in place on the bat's handle. In Washburn Jr., again a hook and loop fastener is used having the same disadvantages as Dalton with the weak retention and non-easily removably engagable attachment, as indicated in FIG. 1, with multiple collars used to move the axial stop away from the butt end of the bat, as the collars brace as against one another and ultimately against the butt end of the bat for the manual grasping by the user.

Next, in the prior art in U.S. Pat. No. 3,469,839 to Pietronuto, et al., disclosed an adjustable bat choke having the characteristics of a bat end comprising a strong flexible body, including a central opening adapted to fit around a bat handle, a cleavage line providing a discontinuity in the bat choke extending through the bat choke's length, a knob portion at one end of said bat choke adapted to simulate a bat knob, and a gripping means adapted to maintain the bat choke on the bat handle at optionally selected positions. In Pietronuto, the gripping means includes a spring confined internally within the body of the flexible bat choke, wherein the bat choke internal diameter also has a high friction surface to help grip the bat, however, the bat choke depending upon the taper of the bat to give the bat choke added frictional gripping power, as the bat choke is a single annular piece flexible shaped element.

Further, in the prior art in United States Patent Application Publication Number 2001/0031674 to McGinnis disclosed is a Baseball Bat Choke-Up Device which includes a C-shaped ring with a hollow center cavity that runs longitudinally through the device. The C-shaped ring in McGinnis has both interior and exterior wall surfaces, wherein the interior wall surface encircles and engages the handle portion of a baseball bat. The C-shaped ring in McGinnis can be separated longitudinally, allowing the Baseball Bat Choke-Up Device to be placed tightly into the desired position around the handle portion of a baseball bat. The C-shaped ring in McGinnis may be secured firmly in place with a hook and loop-type fastener which extends from one side of the longitudinal split to the other, however, having similar problems as previously discussed in Dalton and Washburn Jr., all as having the weak retention and non-easily removably engagable attachment of a hook and loop fastener.

Continuing, in the prior art, for U.S. Pat. No. 5,624,114 to Kelsey disclosed is a resiliently compressible and stretchable sleeve has an opening at one end that is adapted to closely fit around a handle of a baseball bat, and an interior adapted to closely fit around an enlarged end knob which terminates at the handle. The sleeve in Kelsey is positioned to cover the end knob to cushion the batter's hand from vibrations in the end knob and the sleeve can be readily removed from and replaced on the bat. One or more Kelsey sleeves, each having a hole extending completely through it, can be positioned on the handle of the bat to provide a reference for gripping the handle away from the end knob. Thus, Kelsey is a lot like Washburn Jr., in using multiple axially stackable collars as against the butt knob end of the baseball bat to achieve the desired axial stop point for the "choke up" point, with each individual sleeve having minimal axial grip as against the baseball bat via utilizing the butt knob end of the baseball bat as the ultimate axial stop for all of the multiple sleeves.

What is needed is an adjustable article choke constructed partially of flexible material wherein the adjustable choke is easily removably engagable to a variety of article or bat sizes, wherein the adjustable choke or as termed compression collar apparatus securely axially grips the article or bat to provide a firm axial stop for the manual grasping of the article by the user.

SUMMARY OF INVENTION

Broadly, the present invention is a compression collar apparatus for providing compressive force upon an article or for providing an axial manual grasping stop upon the article along an axial longitudinal axis of the article, the compression collar apparatus includes a first arcuate element having a first arcuate axis, the first arcuate element having a first proximal portion and an opposing first distal portion, the first distal portion including an engagement segment that has a plurality of engagement points disposed along the first arcuate axis. Further included in the compression collar apparatus is a second arcuate element having a second arcuate axis, the second arcuate element having a second proximal portion and an opposing second distal portion, the first proximal portion and the second proximal portion have a first pivotal connection to one another about a first pivotal axis for a first pivotal movement, wherein the first pivotal axis and the longitudinal axis are substantially parallel to one another, wherein the first pivotal movement is positioned in a plane that is substantially perpendicular to the first pivotal axis.

An open operational state for the compression collar apparatus is defined as the first and second arcuate elements being moved apart from one another about the first pivotal axis to be able to clear the article and a closed operational state is defined as the first and second arcuate elements being moved toward one another about the first pivotal axis to cause a compressive force upon the article. The closed state is initially effectuated by variably manually compressing the first and second arcuate elements toward one another as against the article via the first pivotal movement to cause the compressive force upon the article, wherein the first and second arcuate elements can be in the closed state at a variable distance apart from one another to accommodate different size articles.

Further included for the compression collar apparatus is a flexible retention arch beam having a free arched state with a free arched axis, a de-arched state with a de-arched state axis, and an intermediate arched state with an intermediate arched state axis, the flexible retention arch beam having a flexible retention arch beam proximal portion and an opposing flexible retention arch beam distal portion, the flexible retention arch beam proximal portion and the second distal portion have a second pivotal connection to one another about a second pivotal axis for a second pivotal movement, wherein the second pivotal axis and the first pivotal axis are substantially parallel to one another. The flexible retention arch beam distal portion having an adjustable interlocking section that has a plurality of interlocking points along the intermediate arched state axis, resulting in a variable removable engagement with the engagement segment forming an interlock as between the flexible retention arch beam and the first arcuate element.

The interlock places the first and second arcuate elements into the closed state, wherein the flexible retention arch beam is in the intermediate arched state, when the first and second arcuate elements are in the closed state about the article, thus putting the first and second arcuate elements in place to cause the compressive force via the flexible retention arch beam that is trying to achieve its free arched state by pulling the second pivotal connection toward the interlock. The de-arched state is effectuated by manually compressibly grasping as between the flexible retention arch beam and grasping by being adjacent to the first pivotal connection to cause the flexible retention arch beam to go from the free arched state to the de-arched state to facilitate the interlock to occur, at which point the manual compressible grasp is released. At this point the flexible retention arch beam progresses to the intermediate arched state to cause the compression force upon the article from the first and second arcuate elements in the closed state.

These and other objects of the present invention will become more readily appreciated and understood from a consideration of the following detailed description of the exemplary embodiments of the present invention when taken together with the accompanying drawings, in which;

REFERENCE NUMBERS IN DRAWINGS

Figure 1:
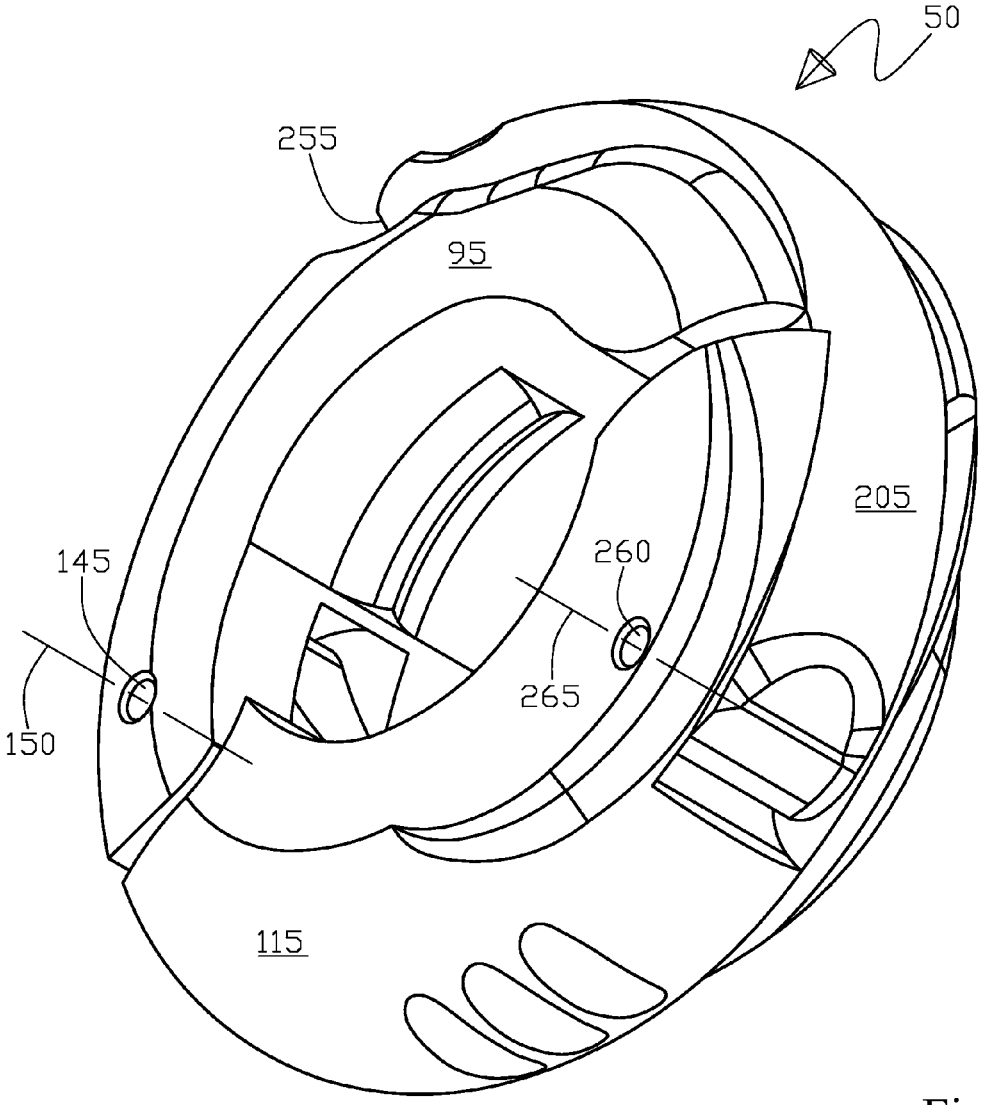
FIG. 1 shows a perspective view of the compression collar apparatus in the closed state including the first and second arcuate elements, the flexible retention arch beam, the first and second pivotal connections, the first and second pivotal axes, and the structural finger depression.

50 Compression collar apparatus
55 Article

60 Different article 55 sizes
65 Longitudinal axis of the article 55
70 Compressive force on the article 55 from the compression collar apparatus 50
75 Axial stop
80 Clearing the article 55
85 Baseball bat
90 Longitudinal axis of the baseball bat 85
95 First arcuate element
100 First arcuate axis
105 First proximal portion
110 First distal portion
111 Engagement segment
112 Plurality of engagement points
115 Second arcuate element
120 Second arcuate axis
125 Second proximal portion
130 Second distal portion
135 Inner surface
140 Elastomeric rib
145 First pivotal connection
150 First pivotal axis
155 First pivotal movement
160 Substantially parallel relationship as between the first pivotal axis 150 and the longitudinal axis 65
165 Plane of the first pivotal movement 155
170 Substantially perpendicular relationship as between the plane 165 and the first pivotal axis 150
175 Open operational state to clear the article 55
180 Moving apart of the first 95 and second 115 arcuate elements to the open operational state 175
185 Closed operational state
195 Moving together of the first 95 and second 115 arcuate elements to the closed operational state 185
200 Variable distance apart of the first 95 and second 115 arcuate elements
205 Flexible retention arch beam
210 Free arched state of the flexible retention arch beam 205
215 Free arched axis of the flexible retention arch beam 205
220 De-arched state of the flexible retention arch beam 205
225 De-arched axis of the flexible retention arch beam 205
230 Intermediate arched state of the flexible retention arch beam 205
235 Intermediate arched axis of the flexible retention arch beam 205
240 Proximal portion of the flexible retention arch beam 205
245 Distal portion of the flexible retention arch beam 205
250 Movement of the flexible retention arch beam 205 as between the free arched state
220, the intermediate state 230, and the de-arched state 220
255 Structural finger depression
260 Second pivotal connection
265 Second pivotal axis
270 Second pivotal movement
275 Plane defined by the second pivotal movement 270
280 Substantially parallel relationship as between the first 150 and second 265 pivot axes
285 Adjustable interlocking section
290 Plurality of interlocking points
295 Variable removable engagement
300 Interlock
305 Pulling the second pivotal connection 260 toward the interlock 300
310 Serrated ratchet toothed ratchet segment
315 Arcuate pitch line
320 Substantially parallel relationship as between the arcuate pitch line 315 and the first arcuate axis 100
325 Plurality of teeth of the serrated ratchet toothed ratchet segment 310
330 Equal arcuate pitch distance of the teeth 325 to one another
331 Minor diameter of the plurality of teeth 325
332 Major diameter of the plurality of teeth 325
335 Minor diameter 331 segment root angle
340 Major diameter 332 segment tip angle
345 Short distance tooth flank
350 Long distance tooth flank
355 Serrated toothed rack
360 Pitch line of the serrated tooth rack 355
365 Tangential relationship as between the serrated toothed rack pitch line 360 and the arcuate pitch line 315 at the interlock 300
370 Plurality of teeth of the serrated toothed rack 355
380 Equal pitch distance of the teeth 370 to one another
385 Tooth tip
390 Tooth root
395 Root pitch line
400 Tip pitch line
405 Equal whole depth from the tooth tip 385 to the tooth root 390
410 Tooth flanks
420 Angle as between each tooth flank 410
425 Short dimension tooth flank 410
430 Long dimension tooth flank 410
435 Removable engagable contact as between a short distance tooth flank 345 and a short dimension tooth flank 425 for the interlock 300
440 Increasing projected length of the long tooth flank 350 distance
500 User hand
505 User finger
510 Variably manually compressing the first 95 and second 115 arcuate elements toward one another as against the article 55
515 Manually compressibly grasping as between the flexible retention arch beam 205 and being adjacent to the first pivotal connection 145
520 Manually inserting a finger 505 into the structural finger depression 255
525 Manually pushing the finger 505 away from the interlock 300
530 Releasing the compressive force 70, 305 on the article 55

DETAILED DESCRIPTION

Figure 2:
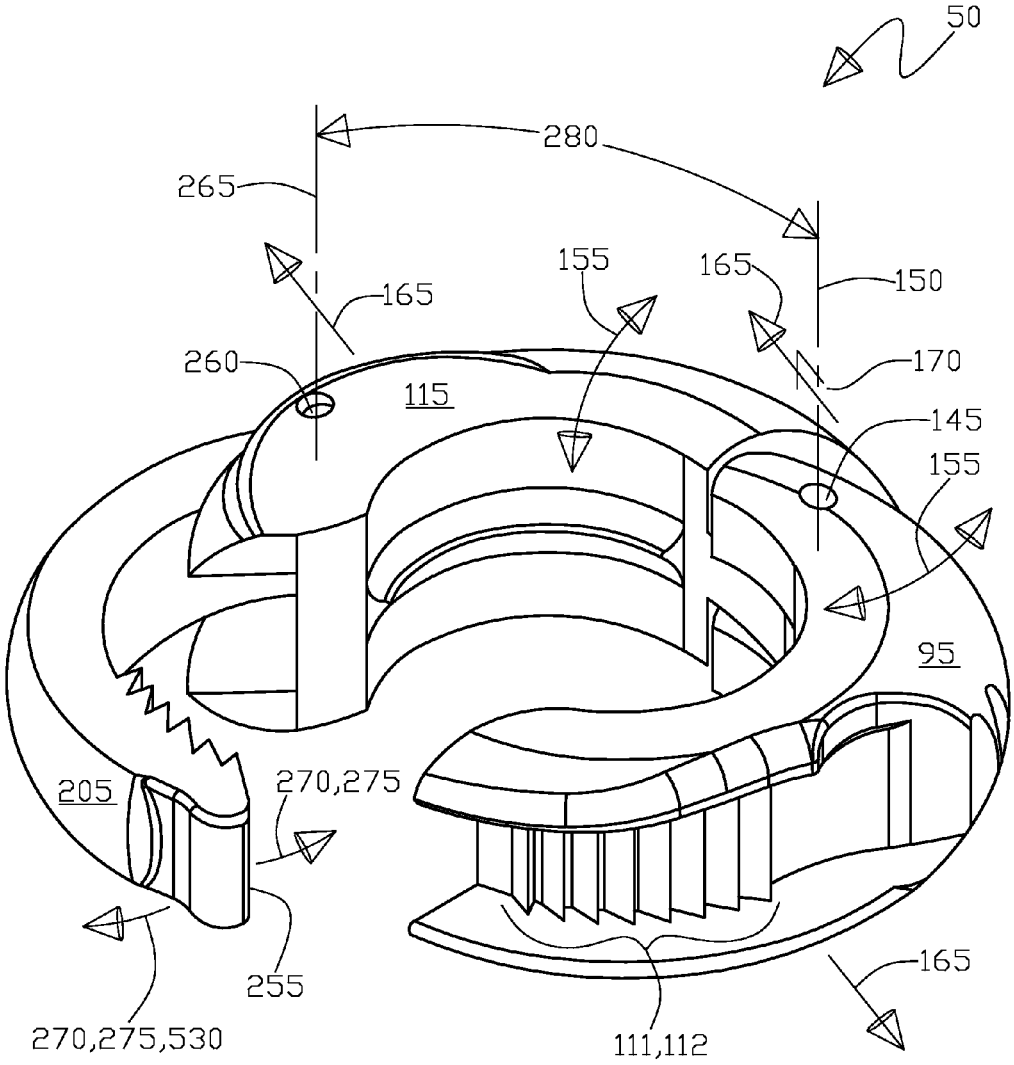
FIG. 2 shows a perspective view of the compression collar apparatus in the open state including the first and second arcuate elements, the flexible retention arch beam, the first and second pivotal connections, the first and second pivotal axes, the structural finger depression, the substantially parallel relationship as between the first and second pivotal axes, the first pivotal movement, the plane of the first pivotal movement, the engagement segment, plurality of engagement points, the second pivotal movement, the second pivotal movement plane, and the releasing of the compressive force.

With initial reference to FIG. 1, shown is a perspective view of the compression collar apparatus 50 in the closed state 185 including the first 95 and second 115 arcuate elements, the flexible retention arch beam 205, the first 145 and second 260 pivotal connections, the first 150 and second 265 pivotal axes, and the structural finger depression 255. Next, FIG. 2 shows a perspective view of the compression collar apparatus 50 in the open state 175 including the first 95 and second 115 arcuate elements, the flexible retention arch beam 205, the first 145 and second 260 pivotal connections, the first 150 and second 265 pivotal axes, the structural finger depression 255, the substantially parallel relationship 280 as between the first 150 and second 265 pivotal axes, the first pivotal movement 155, the plane 165 of the first pivotal movement 155, the engagement segment 111, the plurality of engagement points 112, the second pivotal movement 270, the second pivotal movement plane 275, and the releasing 530 of the compressive force 70 (not shown).

Figure 3:
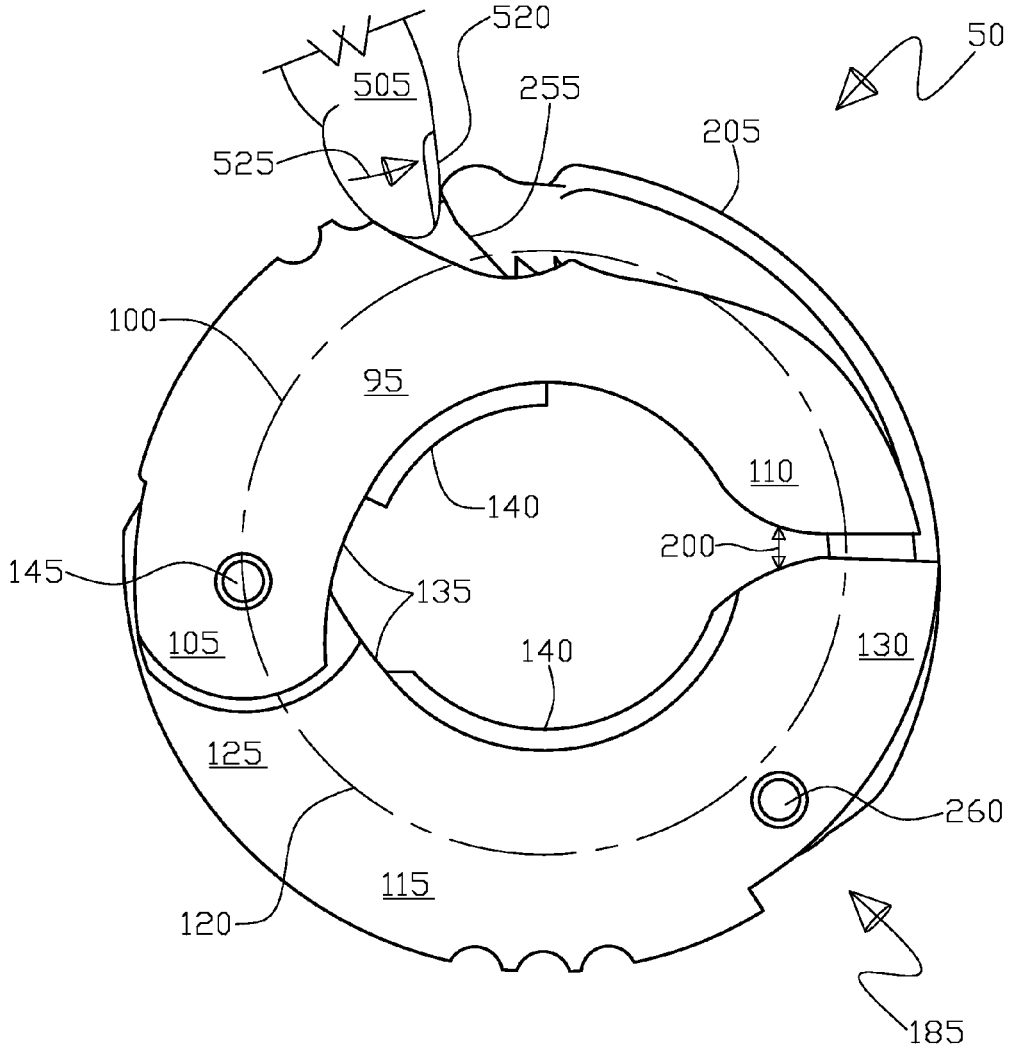
FIG. 3 shows a side elevation view of the compression collar apparatus in the closed state including the first and second arcuate elements, the first and second arcuate axes, the first proximal portion, the first distal portion, the second proximal portion, the second distal portion, the inner surface, the elastomeric rib, the minimal variable distance apart of the first and second arcuate elements, the flexible retention arch beam, the first and second pivotal connections, the structural finger depression, the user finger, manually inserting the finger into the structural finger depression, and the user's finger manually pushing the finger away from the interlock to effectuate the first and second arcuate elements moving toward the open state.

Continuing, FIG. 3 shows a side elevation view of the compression collar apparatus 50 in the closed state 185 including the first 95 and second 115 arcuate elements, the first 100 and second 120 arcuate axes, the first proximal portion 105, the first distal portion 110, the second proximal portion 125, the second distal portion 130, the inner surface 135, the elastomeric rib 140, the minimal variable distance apart 200 of the first 95 and second 115 arcuate elements, the flexible retention arch beam 205, the first 145 and second 260 pivotal connections, the structural finger depression 255, the user finger 505, manually inserting 520 the finger 505 into the structural finger depression 255, and the user's finger 505 manually pushing 525 the finger 505 away from the interlock 300 (not shown) to effectuate the first 95 and second arcuate 115 elements moving toward the open state 175 (not shown).

Figure 4:
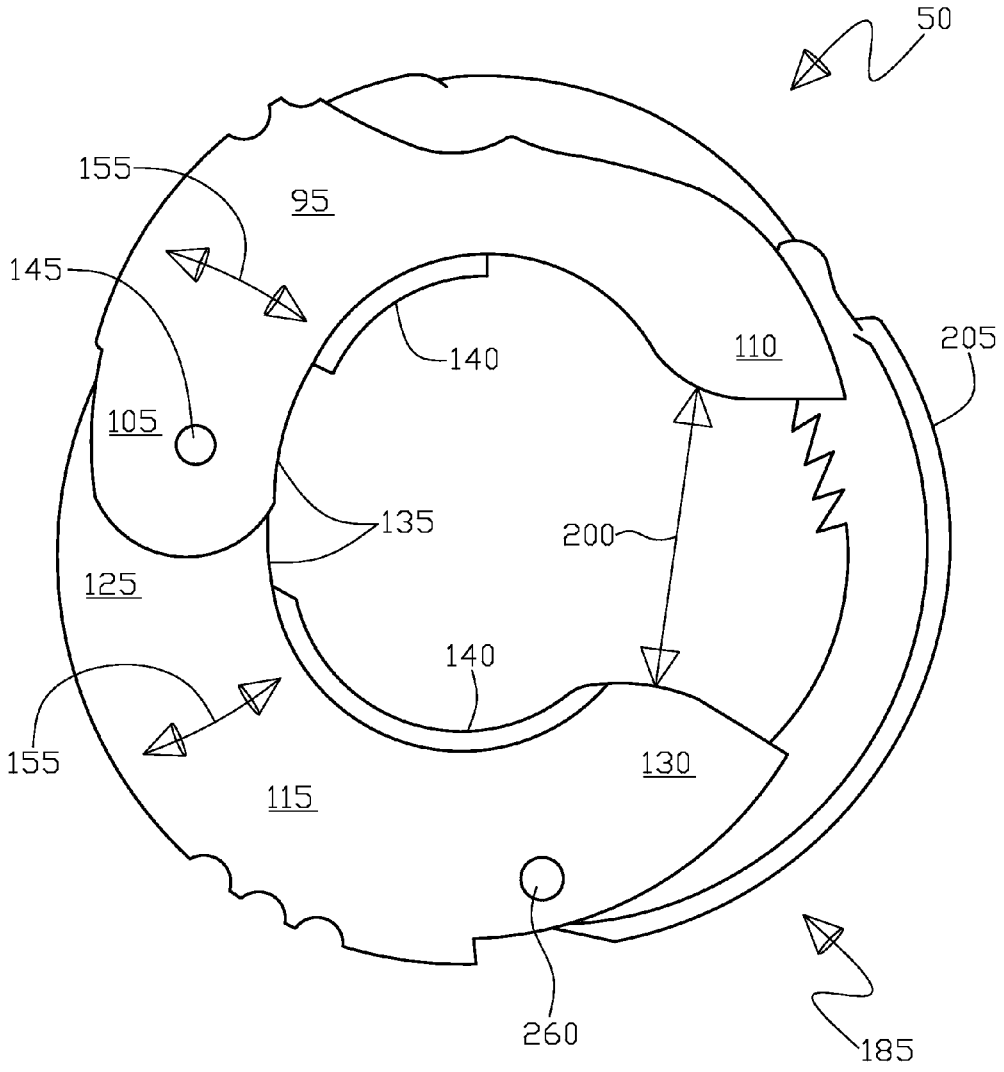
FIG. 4 shows a side elevation view of the compression collar apparatus in the closed state including the first and second arcuate elements, the first proximal portion, the first distal portion, the second proximal portion, the second distal portion, the inner surface, the elastomeric rib, the first pivotal movement, the maximum variable distance apart of the first and second arcuate elements, the flexible retention arch beam, plus the first and second pivotal connections.
Figure 5:
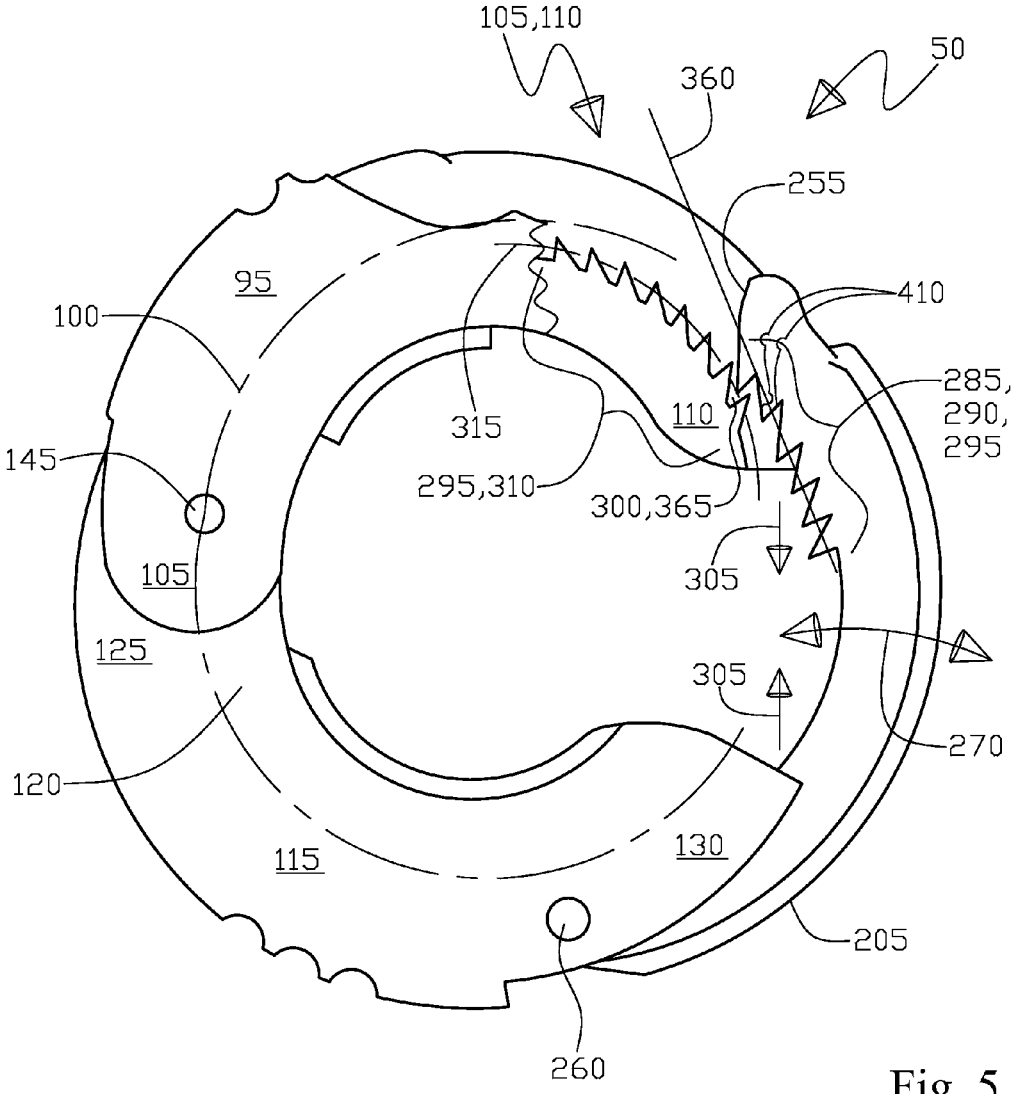
FIG. 5 shows a side elevation view of the compression collar apparatus in the closed state including the first and second arcuate elements, the first proximal portion, the first distal portion, the second proximal portion, the second distal portion, the first and second arcuate axes, the flexible retention arch beam, the first and second pivotal connections, the second pivotal movement, the adjustable interlocking section, the structural finger depression, the plurality of interlocking points, the variable removable engagement, the pitch line for the serrated tooth rack, the tooth flank, the arcuate pitch line, the serrated ratchet toothed ratchet segment, the interlock, the pulling of the second pivotal connection toward the interlock, the tangential relationship as between the serrated toothed rack pitch line and the arcuate pitch line at the interlock point.

Further, FIG. 4 shows a side elevation view of the compression collar apparatus 50 in the closed state 185 including the first 95 and second 115 arcuate elements, the first proximal portion 105, the first distal portion 110, the second proximal portion 125, the second distal portion 130, the inner surface 135, the elastomeric rib 140, the first pivotal movement 155, the maximum variable distance apart 200 of the first 95 and second 115 arcuate elements, the flexible retention arch beam 205, plus the first 145 and second 260 pivotal connections. Continuing, FIG. 5 shows a side elevation view of the compression collar apparatus 50 in the closed state 185 including the first 95 and second 115 arcuate elements, the first proximal portion 105, the first distal portion 110, the second proximal portion 125, the second distal portion 130, the first 100 and second 120 arcuate axes, the flexible retention arch beam 205, the first 145 and second 260 pivotal connections, the second pivotal movement 270, the adjustable interlocking section 285, the structural finger depression 255, the plurality of interlocking points 290, the variable removable engagement 295, the pitch line 360 for the serrated tooth rack 355, the tooth flank 410, the arcuate pitch line 315, the serrated ratchet toothed ratchet segment 310, the interlock 300, the pulling 305 of the second pivotal connection 260 toward the interlock 300, the tangential relationship 365 as between the serrated toothed rack 355 pitch line 360 and the arcuate pitch line 315 at the interlock 300. Note that for pictorial clarity the interlock 300 has the tooth flanks 410 and ratchet segment 310 slightly separated causing the tangent point 365 as between the arcuate pitch line 315 and the pitch line 360 to be distanced apart somewhat-although in practice with the tooth flanks 345 and 425 engaged the pitch lines 315 and 360 would be coincident at the tangent point 365.

Figure 6:
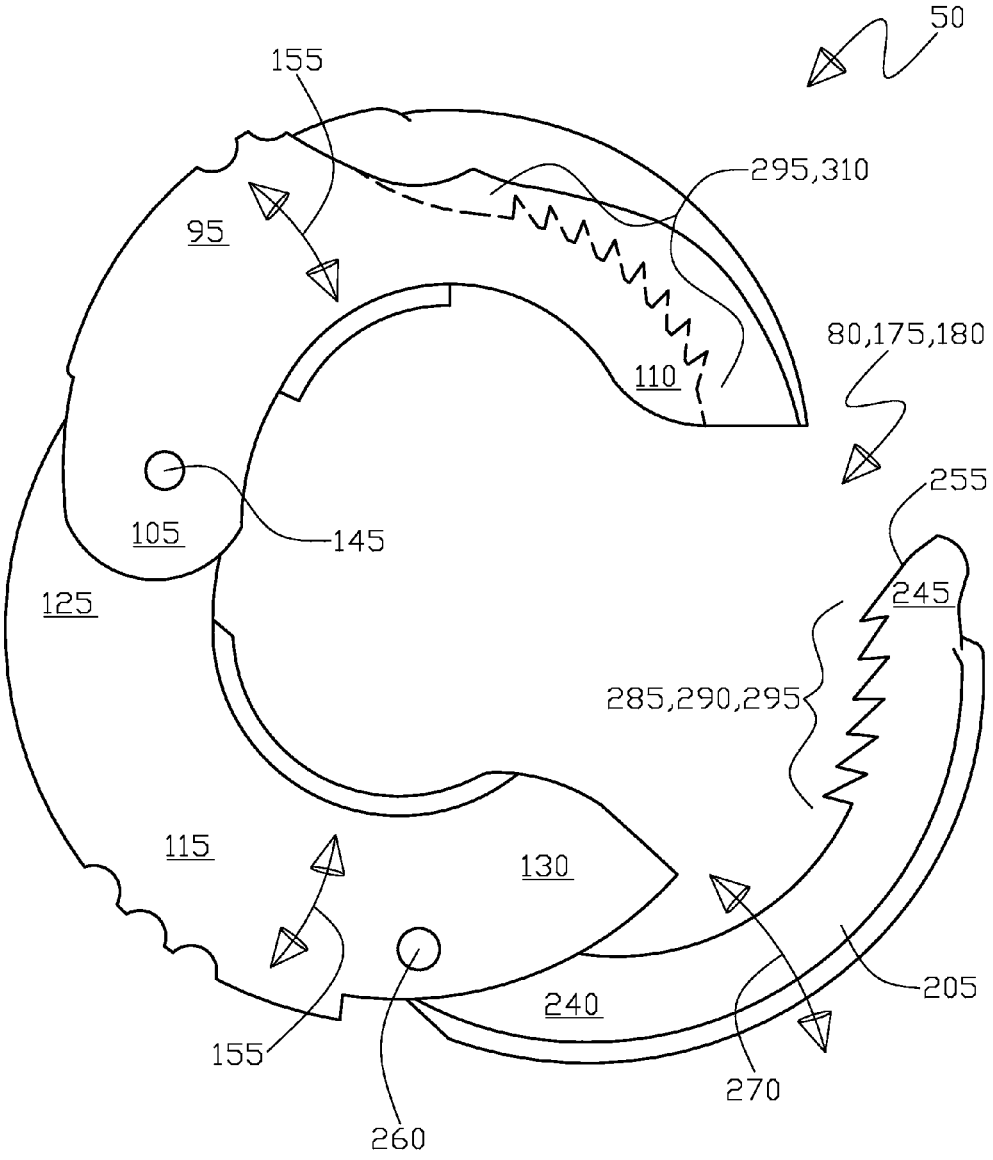
FIG. 6 shows a side elevation view of the compression collar apparatus in the open state including the first and second arcuate elements, the first proximal portion, the first distal portion, the second proximal portion, the second distal portion, the flexible retention arch beam, the proximal and distal portion of the flexible retention arch beam, the first and second pivotal connections, the first pivotal movement, the second pivotal movement, the adjustable interlocking section, the structural finger depression, the plurality of interlocking points, the variable removable engagement, the serrated ratchet toothed ratchet segment, the clearing of the article gap, and the moving apart of the first and second arcuate elements to the open operational state.

Next, FIG. 6 shows a side elevation view of the compression collar apparatus 50 in the open state 175 including the first 95 and second 115 arcuate elements, the first proximal portion 105, the first distal portion 110, the second proximal portion 125, the second distal portion 130, the flexible retention arch beam 205, the proximal 240 and distal 245 portions of the flexible retention arch beam 205, the first 145 and second 260 pivotal connections, the first pivotal movement 155, the second pivotal movement 270, the adjustable interlocking section 285, the structural finger depression 255, the plurality of interlocking points 290, the variable removable engagement 295, the serrated ratchet toothed ratchet segment 310, clearing the article gap 80, and moving apart 180 of the first 95 and second 115 arcuate elements to the open operational state 175.

Figure 7:
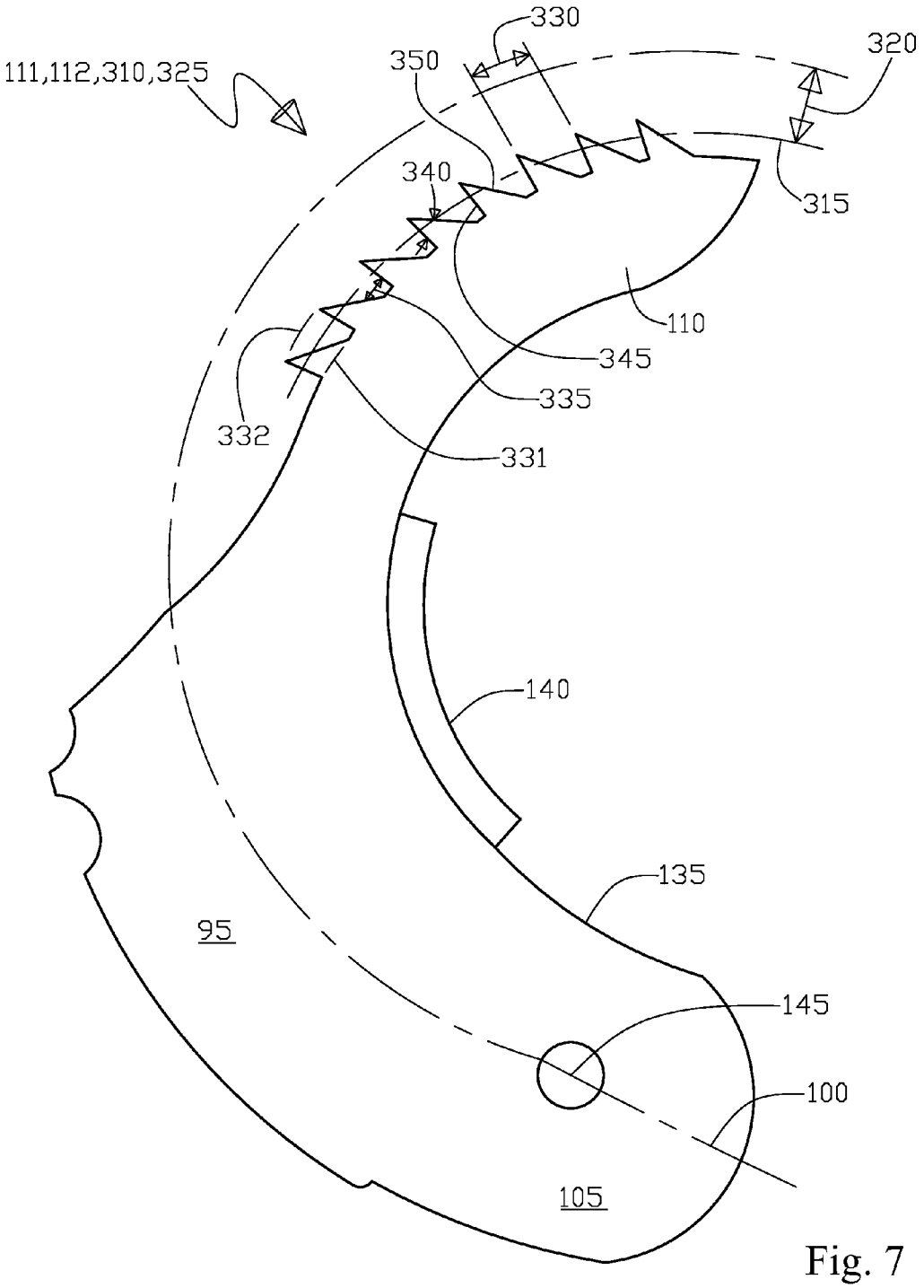
FIG. 7 shown an expanded side elevation view of the first arcuate element including the proximal portion, the distal portion, the first pivotal connection, the first arcuate axis, the inner surface, the elastomeric rib, the engagement segment, the plurality of engagement points, the serrated ratchet toothed ratchet segment, plurality of teeth of the serrated ratchet toothed ratchet segment, the arcuate pitch line, the minor diameter of the plurality of teeth, the major diameter of the plurality of teeth, the minor diameter segment root angle, the major diameter segment tip angle, the short distance tooth flank, the long distance tooth flank, the equal arcuate pitch distance of the teeth one to another, and the substantially parallel relationship as between the arcuate pitch line and the first arcuate axis.

Continuing, FIG. 7 shown an expanded side elevation view of the first arcuate element 95 including the proximal portion 105, the distal portion 110, the first pivotal connection 145, the first arcuate axis 100, the inner surface 135, the elastomeric rib 140, the engagement segment 111, the plurality of engagement points 112, the serrated ratchet toothed ratchet segment, plurality of teeth 325 of the serrated ratchet toothed ratchet segment 310, the arcuate pitch line 315, the minor diameter 331 of the plurality of teeth 325, the major diameter 332 of the plurality of teeth 325, the minor diameter 331 segment root angle 335, the major diameter 332 segment tip angle 340, the short distance tooth flank 345, the long distance tooth flank 350, the equal arcuate pitch distance 330 of the teeth 325 one to another, and the substantially parallel relationship 320 as between the arcuate pitch line 315 and the first arcuate axis 100.

Figure 8:
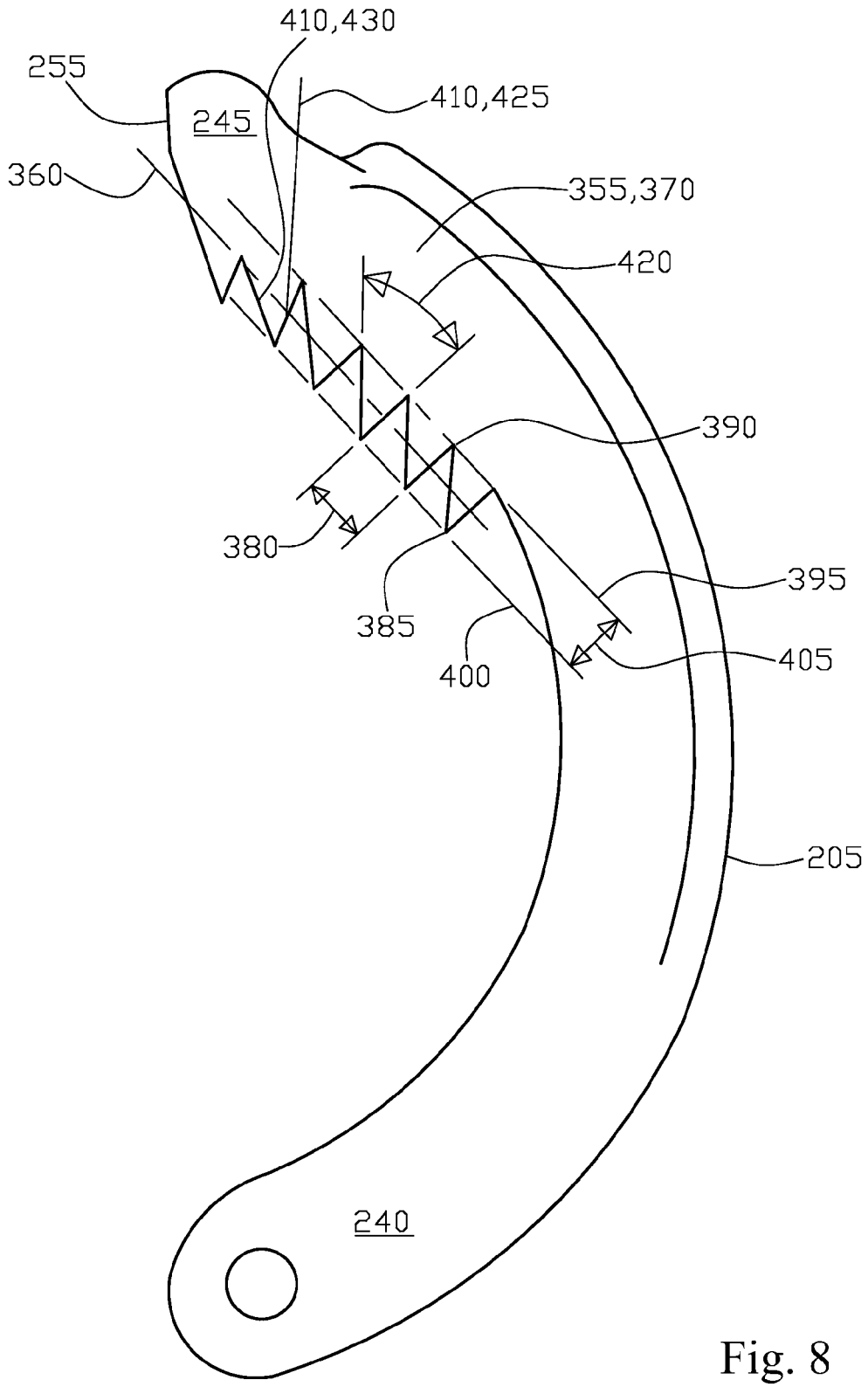
FIG. 8 shows an expanded side elevation view of the flexible retention arch beam with the proximal portion, the distal portion, the structural finger depression, the serrated toothed rack, the plurality of teeth of the serrated toothed rack, the pitch line of the serrated toothed rack, the root pitch line, the tip pitch line, the tooth tip, the tooth root, the equal pitch distance of one tooth to another, tooth flanks, angle as between each tooth flank, long dimension tooth flank, short dimension tooth flank, and equal whole depth from the tooth tip to the tooth root.

Further, FIG. 8 shows an expanded side elevation view of the flexible retention arch beam 205 with the proximal portion 240, the distal portion 245, the structural finger depression 255, the serrated toothed rack 355, the plurality of teeth 370 of the serrated toothed rack 355, the pitch line 360 of the serrated toothed rack 355, the root pitch line 395, the tip pitch line 400, the tooth tip 385, the tooth root 390, the equal pitch distance 380 of one tooth 370 to another, tooth flanks 410, angle 420 as between each tooth flank 410, long dimension tooth flank 430, short dimension tooth flank 425, and equal whole depth 405 from the tooth tip 385 to the tooth root 390.

Figure 9:
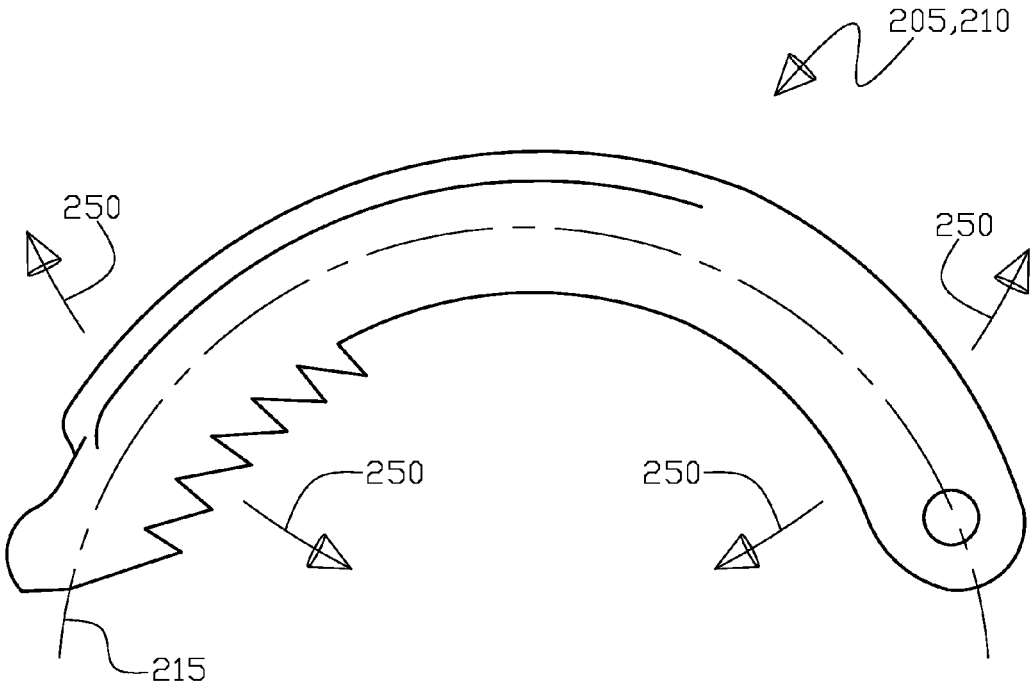
FIG. 9 shows an expanded side elevation view of the flexible retention arch beam in the free arched state with the free arched axis delineating the movement of the flexible retention arch beam, wherein the free arched state relates to the maximum arch position.
Figure 10:
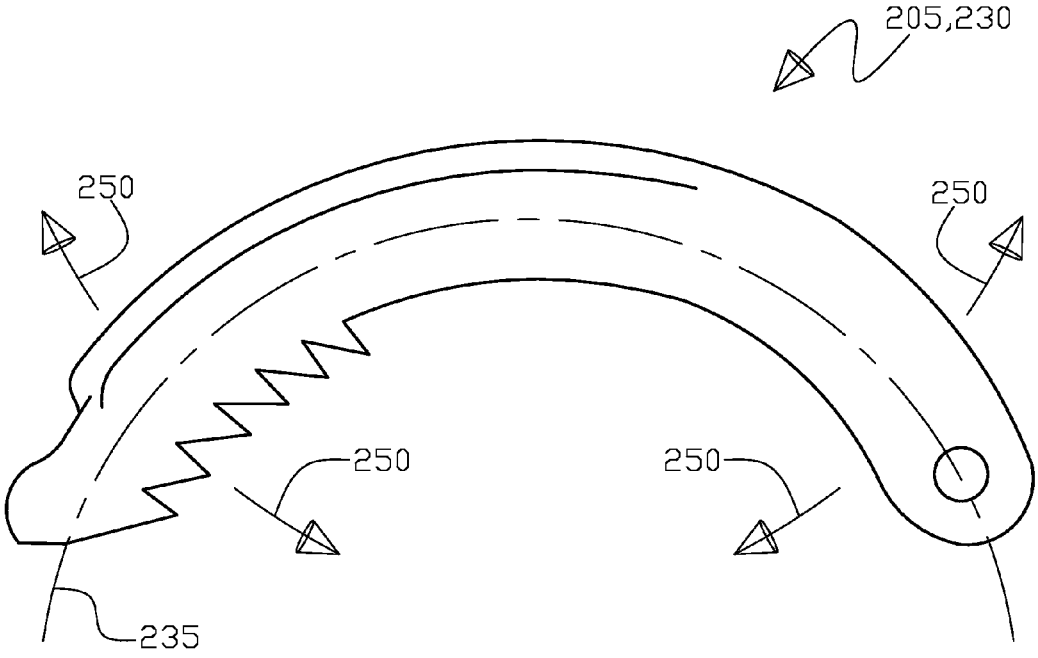
FIG. 10 shows an expanded side elevation view of the flexible retention arch beam in the intermediate arched state with the intermediate arched axis delineating the movement of the flexible retention arch beam, wherein the intermediate arched state relates to the arch position as between the minimum and maximum arch positions.
Figure 11:
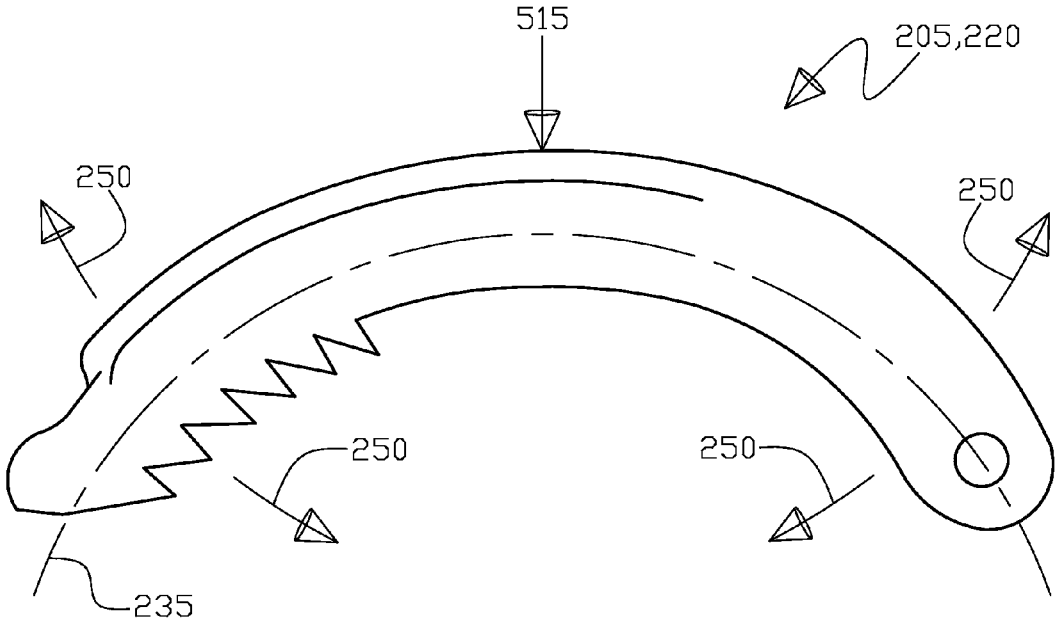
FIG. 11 shows an expanded side elevation view of the flexible retention arch beam in the de-arched state with the de-arched axis delineating the movement of the flexible retention arch beam from the manual compressible grasping, wherein the de-arched state relates to the minimum arch position.

Next, FIG. 9 shows an expanded side elevation view of the flexible retention arch beam 205 in the free arched state 210 with the free arched axis 215 delineating the movement 250 of the flexible retention arch beam 205, wherein the free arched state 210 relates to the maximum arch position. Continuing, FIG. 10 shows an expanded side elevation view of the flexible retention arch beam 205 in the intermediate arched state 230 with the intermediate arched axis 235 delineating the movement 250 of the flexible retention arch beam 205, wherein the intermediate arched state 230 relates to the arch position as between the minimum and maximum arch positions. Yet further, FIG. 11 shows an expanded side elevation view of the flexible retention arch beam 205 in the de-arched state 220 with the de-arched axis 225 delineating the movement 250 of the flexible retention arch beam 205 from the manual compressible grasping 515, wherein the de-arched state 220 relates to the minimum arch position.

Figure 12:
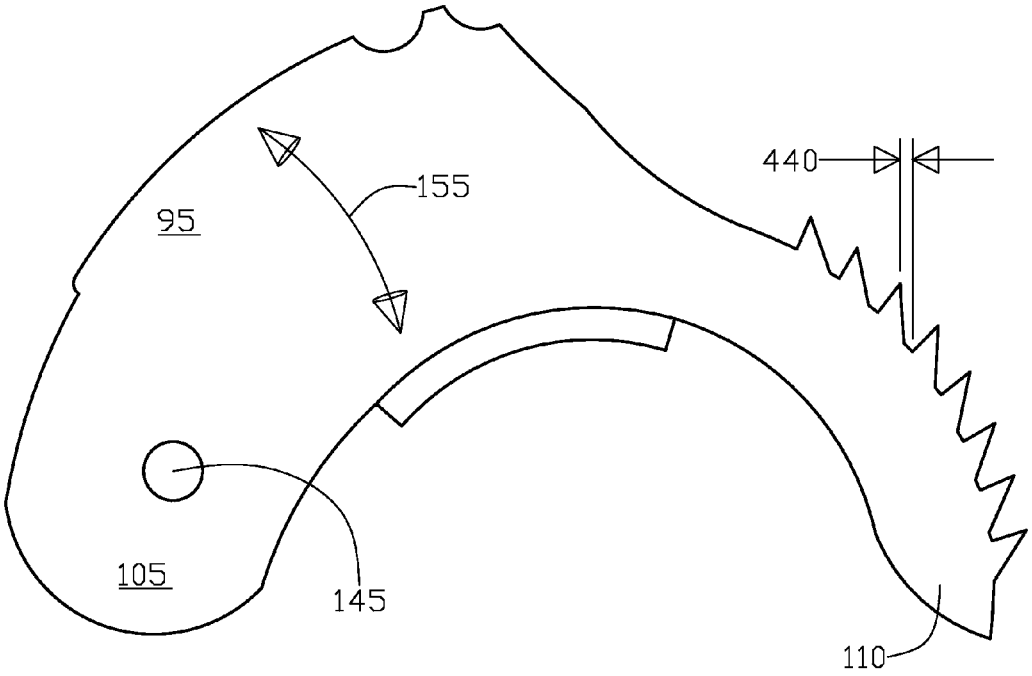
FIG. 12 shows an expanded side elevation view of the first arcuate element with the proximal portion and the distal portion, the first pivotal connection, the first pivotal movement, and the increasing projected length of the long tooth flank distance that varies with the first pivotal movement such that movement counter clockwise increases the projected length and that movement clockwise decreases the projected length.

Moving onward, FIG. 12 shows an expanded side elevation view of the first arcuate element 95 with the proximal portion 105 and the distal portion 110, the first pivotal connection 145, the first pivotal movement 155, and the increasing projected length 440 of the long tooth flank 350 distance that varies with the first pivotal movement 155 such that movement 155 counter clockwise increases the projected length 440 and that movement 155 clockwise decreases the projected length 440.

Figure 13:
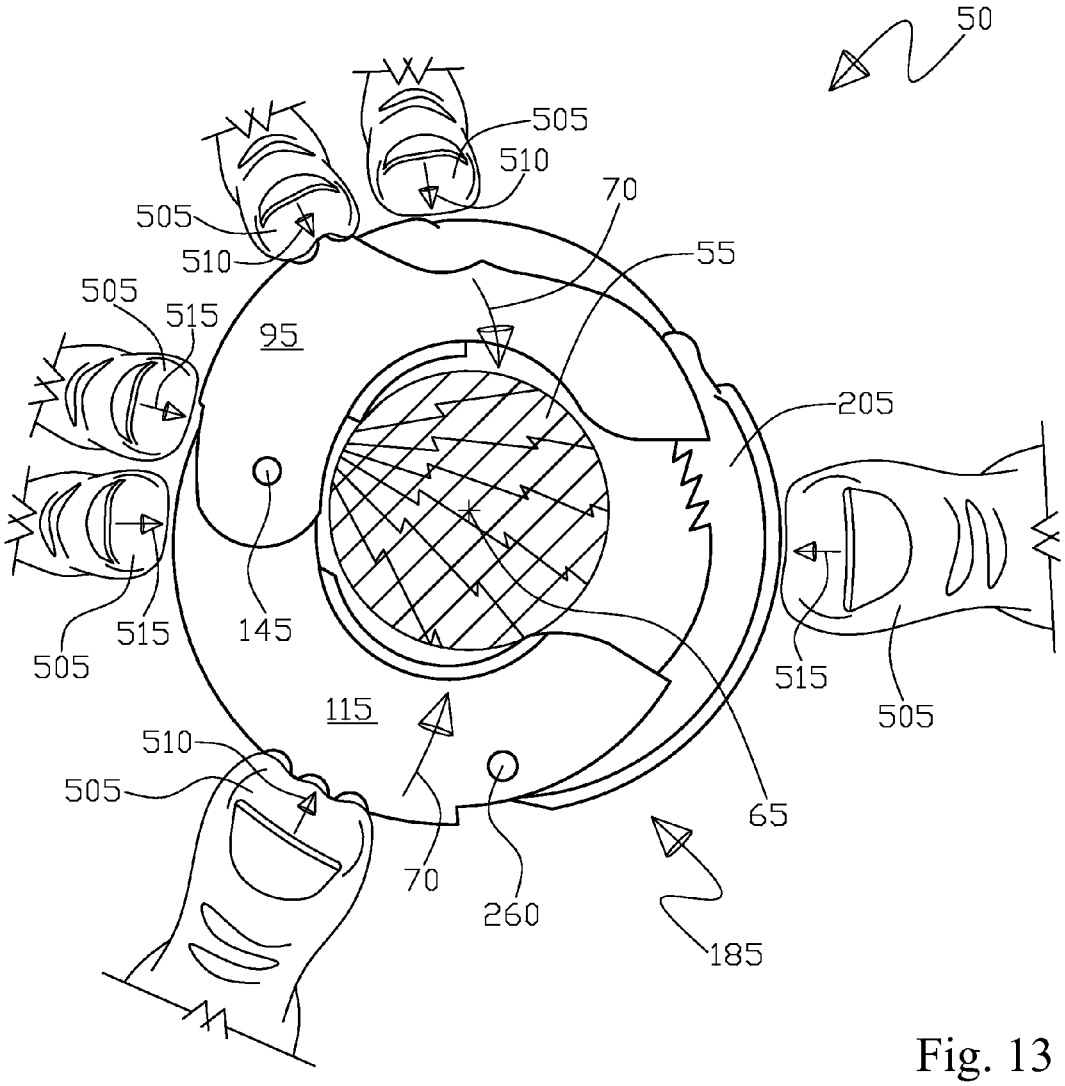
FIG. 13 shows a side elevation view of the compression collar apparatus being assembled onto the article via firstly variably manually compressing the first and second arcuate elements about the first pivotal connection onto the article by positioning the fingers on the first arcuate element outside diameter surface midway between the proximal and distal portions and on the second arcuate element outside diameter also midway between the proximal and distal portions, then squeezing these fingers together resulting in the compressive force-to in effect pinch the article between the first and second arcuate elements, after which using other fingers to manually compress as between the first pivotal connection and the flexible arch retention beam, while continuing to apply compression as between the first and second arcuate elements, thus with the compression as applied to the flexible retention arch beam will take the beam from the free arched state to the de-arched state, wherein the interlock occurs, at which point the manual compression as between the first and second arcuate elements is released and then the manual compression as against the flexible retention arch beam is released thus taking the flexible retention arch beam from the de-arched state to the intermediate state-resulting in the compression collar apparatus compressed as against the article as an axial stop.

Next, FIG. 13 shows a side elevation view of the compression collar apparatus 50 being assembled onto the article 55 via firstly variably manually compressing 510 the first 95 and second 115 arcuate elements about the first pivotal connection 145 onto the article 55 by positioning the user hand 500 and fingers 505 on the first arcuate element 95 outside diameter surface midway between the proximal 105 and distal 110 portions and on the second arcuate element 115 outside diameter also midway between the proximal 125 and distal 130 portions. Further, FIG. 13 shows the squeezing of these fingers 505 together resulting in the compressive force 70—to in effect pinch the article 55 between the first 95 and second 115 arcuate elements, after which using other fingers 505 to manually compress 515 as between the first pivotal connection 145 and the flexible arch retention beam 205, while continuing to apply compression 510 as between the first 95 and second 115 arcuate elements, thus with the compression 515 as applied to the flexible retention arch beam 205 this will take the beam 205 from the free arched state 210 to the de-arched state 220, wherein the interlock 300 occurs. At which point FIG. 13 shows the manual compression 510 as between the first 95 and second 115 arcuate elements is released and then the manual compression 515 as against the flexible retention arch beam 205 is released thus taking the flexible retention arch beam 205 from the de-arched state 220 (when compression 515 is effected) to the intermediate arched state 230—resulting in the compression collar apparatus 50 compressed 70 as against the article 55 from the pulling 305 of the beam 205 as against the second pivotal connection and the interlock 300, resulting in the compression collar apparatus 50 in the closed state 185 acting as an axial stop for manual grasping of the article 55 along the longitudinal axis 65.

Figure 14:
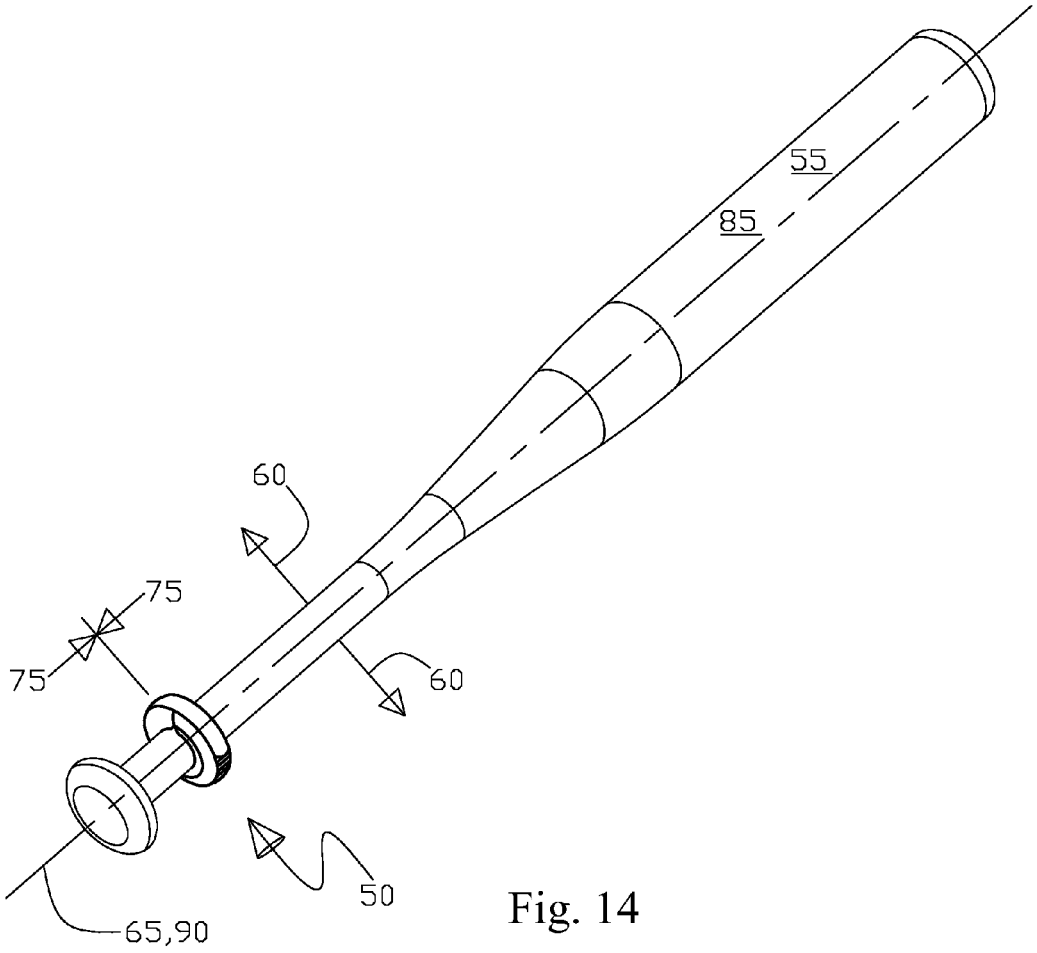
FIG. 14 shows as assembled perspective view of the compression collar apparatus in the closed state about the article—or baseball bat as shown, on its longitudinal axis, wherein the compression collar apparatus provides the axial stop for "choking up" on the baseball bat, also noting that the article can come in different sizes.
Figure 15:
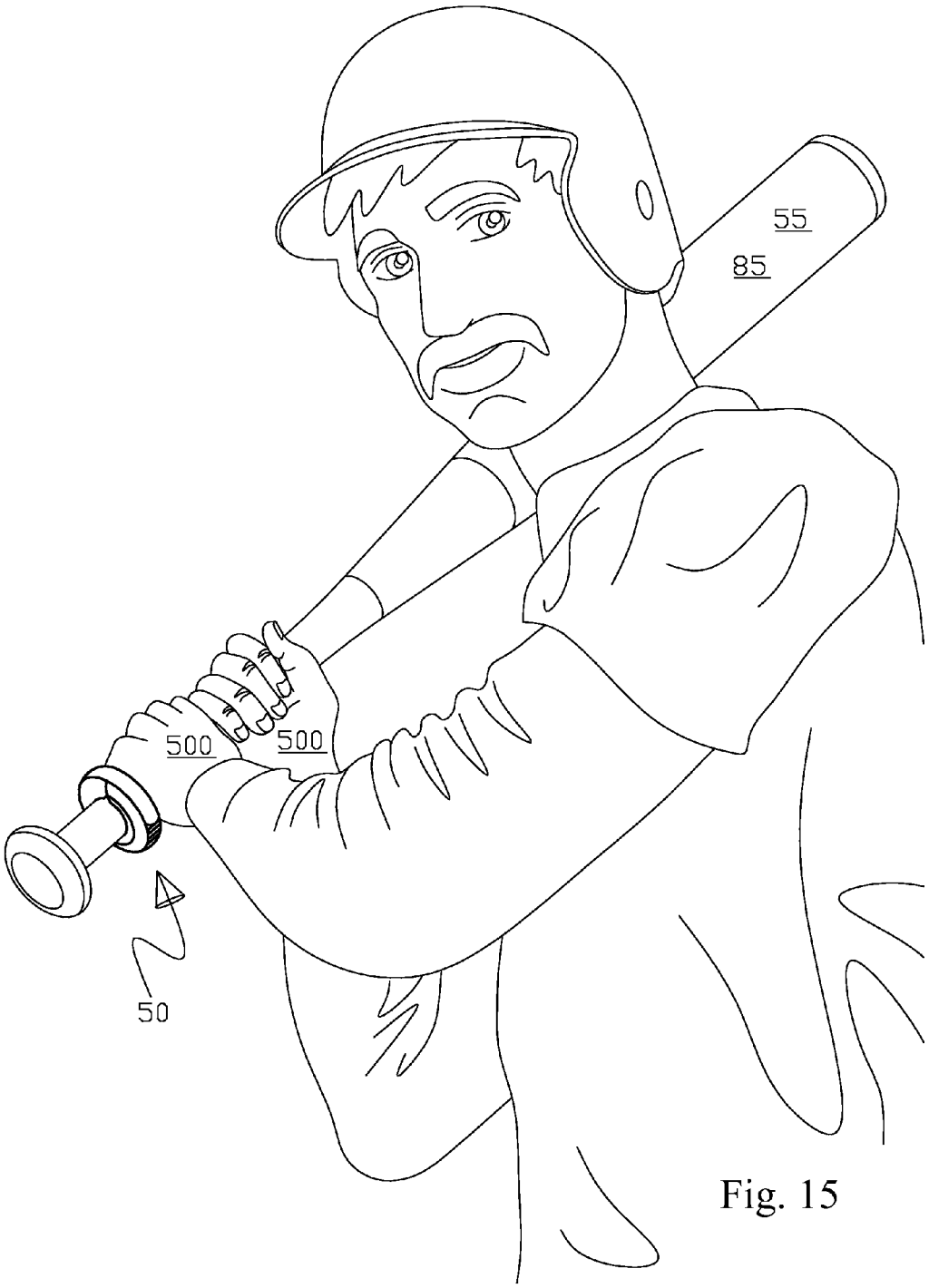
FIG. 15 shows a perspective use view of the compression collar apparatus in a closed state about the article or baseball bat, wherein the user's hands are using the compression collar apparatus as the axial stop for a more controlled swing of the baseball bat.

Continuing, FIG. 14 shows as assembled perspective view of the compression collar apparatus 50 in the closed state 185 about the article 55—or baseball bat 85 as shown, on its longitudinal axis 65 or 90, wherein the compression collar apparatus 50 provides the axial stop 75 for "choking up" on the baseball bat 85, also noting that the article 55 can come in different sizes 60, wherein the compression collar apparatus 50 can accommodate these different sizes 60. Further, FIG. 15 shows a perspective use view of the compression collar apparatus 50 in a closed state 185 about the article 55 or baseball bat 85, wherein the user's hands 500 are using the compression collar apparatus 50 as the axial stop 75 for a more controlled swing of the baseball bat 85. Next, FIG. 16 shows a perspective view of the compression collar apparatus 50 in the open state 175 provisionally about the article 55 showing the substantially parallel relationship 160 as between the first pivotal connection 145 first pivotal axis 150 and the longitudinal axis 65, with the clearing 80 of the article 55 via moving apart 180 of the first 95 and second 115 arcuate elements after releasing the compressive force 530 on the article 55 via disengaging the interlock 300.

Broadly, in referring to FIGS. 1 through 6, the present invention of the compression collar apparatus 50 for providing compressive force 70 upon the article 55 or for providing an axial manual grasping stop 75 upon the article 55 along an axial longitudinal axis 65 of the article 55, also see FIGS. 13 through 16 for use of the compression collar apparatus 50. The compression collar apparatus 50 includes a first arcuate element 95 having a first arcuate axis 100, the first arcuate element 95 having a first proximal portion 105 and an opposing first distal portion 110, the first distal portion 110 including an engagement segment 111 that has a plurality of engagement points 112 disposed along the first arcuate axis 100, as best shown in FIGS. 5 and 7. Further included in the compression collar apparatus 50 is a second arcuate element 115 having a second arcuate axis 120, the second arcuate element 115 having a second proximal portion 125 and an opposing second distal portion 130, the first proximal portion 105 and the second proximal portion 125 have a first pivotal connection 145 to one another about a first pivotal axis 150 for a first pivotal movement 155, wherein the first pivotal axis 150 and the longitudinal axis 65 are substantially parallel 160 to one another, wherein the first pivotal movement 155 is positioned in a plane 165 that is substantially perpendicular 170 to the first pivotal axis 150, see FIGS. 1 through 6 and 16.

Figure 16:
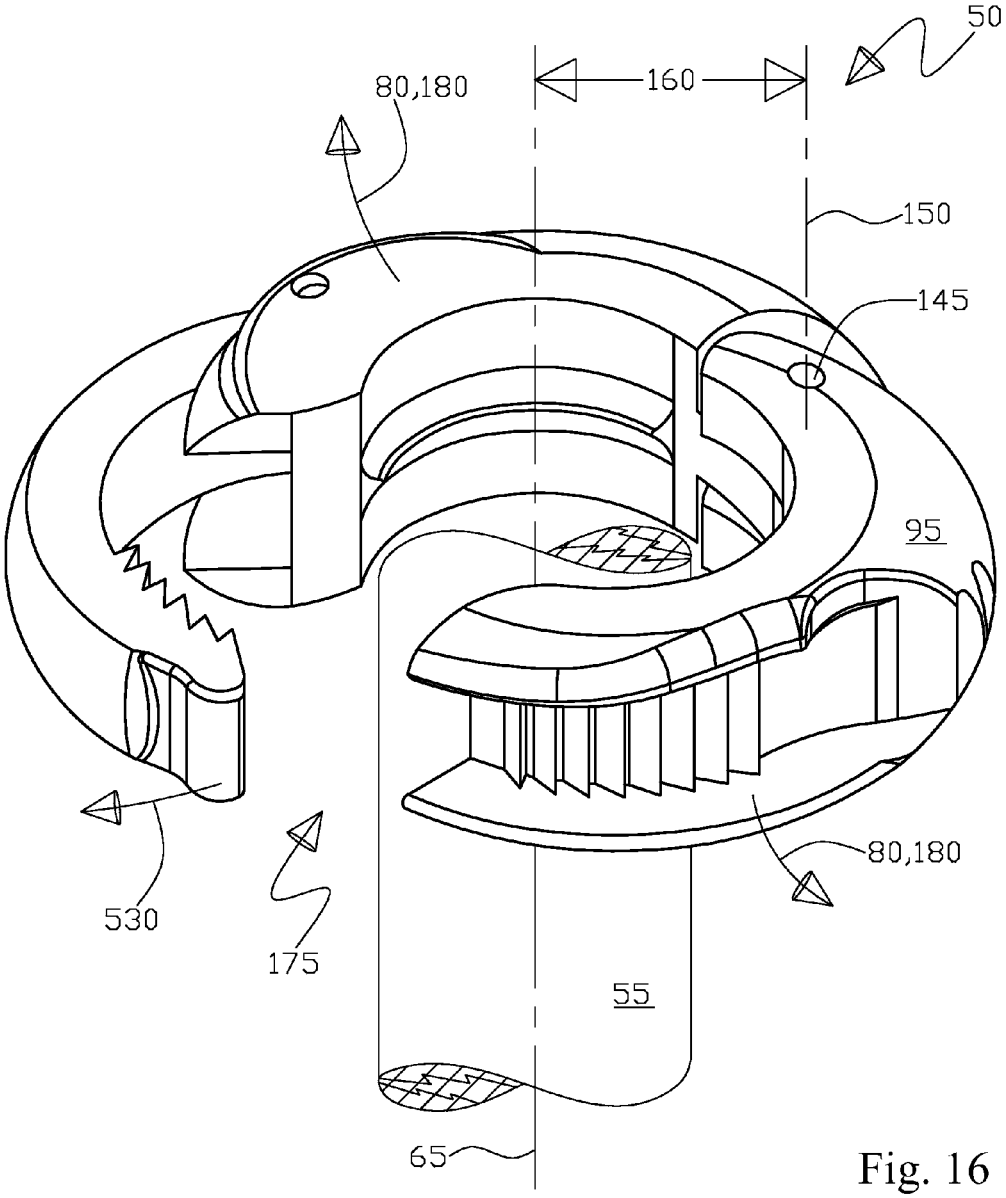
FIG. 16 shows a perspective view of the compression collar apparatus in the open state provisionally about the article showing the substantially parallel relationship as between the first pivotal connection first pivotal axis and the longitudinal axis, with the clearing of the article via moving apart of the first and second arcuate elements after releasing the compressive force on the article.

Referring to FIGS. 2, 6, and 16, the open operational state 175 for the compression collar apparatus 50 is defined as the first 95 and second 115 arcuate elements being moved apart 180 from one another about the first pivotal axis 150 to be able to clear 80 the article 55 and a closed operational state 185 is defined as the first 95 and second 115 arcuate elements being moved toward 155 one another about the first pivotal axis 150 to cause a compressive force 70 upon the article 55, as best seen in FIG. 13. The closed state 185 is initially effectuated by variably manually compressing 510 the first 95 and second 115 arcuate elements toward one another as against the article 55 via the first pivotal movement 155 to cause the compressive force 70 upon the article 55, wherein the first 95 and second 115 arcuate elements can be in the closed state 185 at a variable distance apart 200 from one another to accommodate different size 60 articles 55, see FIGS. 3 and 4.

Looking at particular to FIGS. 8 through 11, further included for the compression collar 50 is a flexible retention arch beam 205 having a free arched state 210 with a free arched axis 215, a de-arched state 220 with a de-arched state axis 225, and an intermediate arched state 230 with an intermediate arched state axis 235, the flexible retention arch beam 205 having a flexible retention arch beam 205 proximal portion 240 and an opposing flexible retention arch beam 205 distal portion 245. The flexible retention arch beam 205 proximal portion 240 and the second distal portion 130 have a second pivotal connection 260 to one another about a second pivotal axis 265 for a second pivotal movement 270, wherein the second pivotal axis 265 and the first pivotal axis 150 are substantially parallel 280 to one another, see FIG. 2. The flexible retention arch beam 205 distal portion 245 having an adjustable interlocking section 285 that has a plurality of interlocking points 290 along the intermediate arched state axis 235, resulting in a variable removable engagement 295 with the engagement segment 111 forming an interlock 300 as between the flexible retention arch beam 205 and the first arcuate element 95, see FIGS. 7 and 8.

The interlock 300 places the first 95 and second 115 arcuate elements into the closed state 185, wherein the flexible retention arch beam 205 is in the intermediate arched state 230, when the first 95 and 115 second arcuate elements are in the closed state 185 about the article 55, thus putting the first 95 and 115 second arcuate elements in place to cause the compressive force 70 via the flexible retention arch beam 205 that is trying to achieve its free arched state 210 by pulling 305 the second pivotal connection 260 toward the interlock 300, see FIG. 5 in particular and FIGS. 1, 3, 4, 13, 14, and 15. The de-arched state 220 is effectuated by manually compressibly 515 grasping as between the flexible retention arch beam 205 and grasping by being adjacent to the first pivotal connection 145 to cause the flexible retention arch beam 205 to go from the free arched 210 state to the de-arched state 220 to facilitate the interlock 300 to occur, at which point the manual compressible grasp 515 is released and thereafter manual compression 510 is released, see FIG. 13 in particular. At this point the flexible retention arch beam 205 progresses to the intermediate arched state 230 to cause the compression force 70 upon the article 55 from the first 95 and second 115 arcuate elements in the closed state 185 as originating from pulling force 305 as shown in FIG. 5.

Alternatively, on the compression collar apparatus 50 relating to the flexible retention arch beam 205 distal portion 245 can further include a structural finger depression 255 positioned adjacent to the adjustable interlocking section 285, see FIGS. 2, 3, 5, and 6. Wherein operationally by manually inserting 520 a finger 505 into the structural finger depression 255 and pushing 525 the finger 505 away from the interlock 300 to cause the flexible retention arch beam 205 to go to the de-arched state 220 from the intermediate arched state 230, thus going to the free arched state 210 when disengaging the interlock 300, thus releasing the pulling force 305 to allow the first 95 and second 115 arcuate elements to go from the closed state 185 to the open state 175 and releasing the compressive force 70 on the article 55, see FIGS. 3, 5, 6, and 16.

Optionally, on the compression collar apparatus 50 relating to the engagement segment 105, which can have a serrated ratchet toothed segment 310 having an arcuate pitch line 315 that is substantially parallel 320 to the first arcuate axis 100, see in particular FIG. 7 and also FIGS. 2, 5, 6, 12, and 16. Continuing, for the compression collar apparatus 50 on the serrated ratchet toothed segment 310, it can be formed from a plurality of teeth 325 that each have an equal arcuate pitch distance 330 to one another, a minor diameter 331 segment root angle 335 that is greater that a major diameter 332 segment tip angle 340, resulting in a short distance tooth flank 345 from the minor diameter 331 segment to the major diameter 332 segment and a long distance tooth flank 350 from the minor diameter 331 segment to the major diameter 332 segment for each tooth 325, see FIG. 7 in particular and also FIGS. 2, 5, 6, and 16. Preferably, the pitch distance 330 is about 0.90 inches, and the tip angle 340 is preferably about 41 degrees, and the preferred distance as between the minor diameter 331 and the major diameter 332 on a radial basis, being the tooth 325 depth is about 0.80 inches, as shown in FIG. 7.

Further, on the compression collar apparatus 50, relating to the adjustable interlocking section 285 is preferably a serrated toothed rack 355 having a pitch line 360 that is substantially linear, wherein the serrated toothed rack 355 pitch line 360 forming a tangential relationship 365 with the arcuate pitch line 315 at the interlock 300, see FIG. 5 in particular, and FIGS. 2, 4, 6, 8, 9 through 13, and 16. Continuing, on the compression collar apparatus 50 wherein optionally the serrated toothed rack 355 is formed from a plurality of teeth 370 that each have an equal pitch distance 380 to one another and an equal whole depth 405 as measured from the tooth tip 385 to the tooth root 390, and an angle 420 as between each tooth flank 410 that progressively increases for each tooth 370 in going from adjacent to the flexible retention arch beam 205 proximal portion 240 to the flexible retention arch beam 205 distal end portion 245, see FIG. 8. This resulting in each tooth 370 having a short dimension tooth flank 425 from a root pitch line 395 to a tip pitch line 400 and a long dimension tooth flank 430 from a root pitch line 395 to a tip pitch line 400, wherein each of the short 425 and long 430 dimensions of the tooth flanks 410 both progressively increase in length-from root 390 to tip 385, for each tooth 370 in going from adjacent to the flexible retention arch beam 205 proximal portion 240 to the flexible retention arch beam 205 distal end portion 245, again see FIG. 8. The interlock 300 is defined as a removably engagable contact 435 as between a single short distance tooth flank 345 and a single short dimension tooth flank 425, the progressively increasing long dimension tooth flanks 430 structurally accommodate an increasing projected length 440 of the long tooth flank distance 350 due to the first pivotal movement 155 of the first 95 and second 115 arcuate elements moving apart 180 from one another to facilitate a larger size 60 article 55, see FIGS. 5 and 12 in particular and FIGS. 2, 6, and 16.

Thus, the variable length tooth flanks 425, 430 act as a Vernier type scale, i.e. by having unequal teeth 370 sizing that accommodates alignment of the single short distance tooth flank 345 and a single short dimension tooth flank 425 forming the interlock 300, wherein for various size 60 articles 55, the particular teeth 325, 370 that form the interlock 300 are different. Further, as the first arcuate element 95 moves 155 toward a more open state 175 (this accommodating larger size 60 articles 55) the projection distance 440 increases, wherein the projection 440 is projected as against the pitch line 360, see FIGS. 5 and 12, requiring that the eventual mating flank 425 be angled as between root 390 and tip 385 to better match the mating flank 345 angle as between root diameter 331 and tip diameter 332 to form the interlock 300. Plus this coupled with the flexibility of the retention arch beam 205 that during the compression force 515 from the finger 505, see FIG. 13, flexes the beam 205 from the free arched state 210 to the de-arched state 220, see FIGS. 9, 10, and 11 to move the tooth tips 385 to better facilitate tooth flank 425 to grab tooth flank 345 to form the interlock 300 at variable positions of the first arcuate element 95 from movement 155 to ultimately accommodate various sizes 60 of the article 55.

Looking toward FIG. 8, preferably, for the angle 420 as between each tooth flank 410 that progressively increases for each tooth 370 in going from adjacent to the flexible retention arch beam 205 proximal portion 240 to the flexible retention arch beam 205 distal end portion 245 the angles 420 progress from about 41 degrees to about 50 degrees. In addition, preferably for each of the short 425 and long 430 dimensions of the tooth flanks 410 both progressively increase for each tooth 370 in going from adjacent to the flexible retention arch beam 205 proximal portion 240 to the flexible retention arch beam 205 distal end portion 245, the increase in the short dimension 425 and the increase in the long dimension 430 are controlled by the tooth tips 385 being equidistant to one another as defined in the equal pitch distance 380 of about 0.08 inch and as the angle 420 increases and the equal whole depth 405 being preferably about 0.08 inches stays consistent, the tooth roots 390 shift in relation to the tooth tips 385 in the same direction as the increasing angles 420, thus the shift going from the proximal portion 240 toward the distal portion 245 resulting in increases in the short dimension 425 and increases in the long dimension 430 as between the tip 385 and root 390, as only the first short dimension tooth flank 425 that is closest to the proximal end portion 240 is positioned perpendicular to the pitch line 360, as shown in FIG. 8.

Additionally, referring to FIGS. 5, 9, 10, 11, and 13 for the compression collar apparatus 50 relating to the flexible retention arch beam 205, that has a flexing stiffness for movement 305 as between the free arched state 210, the intermediate arched state 230, and the de-arched state 220. Wherein the stiffness is measured in a plane 275 that is defined via the second pivotal movement 270 as between the second pivotal axis 265 and the adjustable interlocking section 285 with the stiffness being preferably in the range of about 1,000 pounds per inch to ultimately create the compressive force 70 while the flexible retention arch beam 205 is in the intermediate arched state 230. The stiffness of the flexible retention arch beam 205 is best shown by the manual compression 515 via the finger 505 that acts as against the interlock 30 and the second pivotal connection 260, as best seen in FIGS. 5 and 13 resulting in the three states of the free arched state 210, the intermediate arched state 230, and the de-arched state 220. Note that the preferred stiffness of about 1,000 pounds per inch could be more or less depending upon materials of construction for the flexible retention arch beam 205.

Continuing, on the compression collar apparatus 50, wherein the flexible retention arch beam 205 is preferably constructed of nylon or a suitable equivalent to accommodate the desired transitions from the free arched state 210, to the intermediate arched state 230, and to the de-arched state 220. Also as an option, for the compression collar apparatus 50 related to the first 95 and second 115 arcuate elements each can further include an inner surface 135 wherein is disposed an elastomeric rib 140 that is intersticed as between the inner surface 135 and the article 55 when the first 95 and second 115 arcuate elements are in the closed state 185, being operational to further enhance the grip or frictional contact from the compressive force 70 upon the article 55 from the first 95 and second 115 arcuate elements in the closed state 185 to ultimately strengthen the axial stop 75, see FIGS. 3, 4, 13, 14, and 15.

METHOD OF USE

Referring specifically to FIGS. 2, 4, 5, 6, 13 through 16, for a method of using a compression collar apparatus 50 comprising the following steps of firstly providing the article 55 having a longitudinal axis 65, the article 55 can also be in the form of a baseball bat 85 with its own longitudinal axis 90 or any other article 55 that could be applicable that could use the compression collar apparatus 50 that can potentially provide an axial stop 75, this would include but not be limited to broom handles, hockey sticks, golf clubs, Lacrosse sticks, pole vaults, or medical uses such as limbs, and the like. A next step of providing the compression collar apparatus 50 as previously described, see FIGS. 1 through 6.

Further, a step of compressing manually 510 with fingers 505 with a selected compression force in a variable distance manner 200 the first 95 and second 115 arcuate elements toward 70 one another 195 as against the article 55 via the first pivotal movement 155, wherein the first 95 and second 115 arcuate elements can be in the closed state 185 at a variable distance 200 apart from one another to accommodate different size 60 articles 55, further continuing the step of compressing manually 510 through the following step, see in particular FIGS. 3, 4, and 13.

Next, a step of grasping manually 515 with fingers 505 in a compressive manner as between the flexible retention arch beam 205 and being adjacent to the first pivotal connection 145 to cause the flexible retention arch beam 205 to go from the free arched state 210 to the de-arched state 220 to facilitate the interlock 300 to occur, see FIGS. 3, 4, 5, and 13, while notably still retaining compression force 510 as delineated above. Subsequently a next step of releasing the manual compressible grasp 510, wherein the flexible retention arch beam 205 progresses from the de-arched state 220 to the intermediate arched state 230, thus placing the compression collar 50 in the closed state 185 with a compression force 70 on the article 55 originating from the pulling force 305 that ultimately translates into the compressive force 70, see FIGS. 5 and 13.

Moving onward, an optional step for the method of using the compression collar apparatus 50 can further comprise a step of inserting manually 520 a finger 505 into the structural finger depression 255 and pushing 525 the finger 505 away from the interlock 300 to cause the flexible retention arch beam 205 to go to from the de-arched state 220 from the intermediate arched state 230, thus going to the free arched state 210 when disengaging the interlock 300 to allow the first 95 and second 115 arcuate elements to go from the closed state 185 to the open state 175, and releasing the compressive force 70 on the article 55 allowing the compression collar 50 to be removed or cleared 175 from the article 55, see FIGS. 2, 3, 5, 6, and 16.

CONCLUSION

Accordingly, the present invention of an compression collar apparatus has been described with some degree of particularity directed to the embodiments of the present invention. It should be appreciated, though, that the present invention is defined by the following claim construed in light of the prior art so modifications or changes may be made to the exemplary embodiments of the present invention without departing from the inventive concepts contained therein.

The invention claimed is:

1. A compression collar apparatus for providing compressive force upon an article or for providing an axial manual grasping stop upon the article along an axial longitudinal axis of the article, said compression collar apparatus comprising:

(a) a first arcuate element having a first arcuate axis, said first arcuate element having a first proximal portion and an opposing first distal portion, said first distal portion including an engagement segment that has a plurality of engagement points disposed along said first arcuate axis, wherein said engagement segment is a serrated ratchet toothed segment having an arcuate pitch line that is substantially parallel to said first arcuate axis, wherein said serrated ratchet toothed segment is formed from a plurality of teeth that each have an equal arcuate pitch distance to one another, a minor diameter segment root angle that is greater that a major diameter segment tip angle, resulting in a short distance tooth flank from said minor diameter segment to said major diameter segment and a long distance tooth flank from said minor diameter segment to said major diameter segment for each tooth;

(b) a second arcuate element having a second arcuate axis, said second arcuate element having a second proximal portion and an opposing second distal portion, said first proximal portion and said second proximal portion have a first pivotal connection to one another about a first pivotal axis for a first pivotal movement, wherein said first pivotal axis and the longitudinal axis are substantially parallel to one another, wherein said first pivotal movement is positioned in a plane that is substantially perpendicular to said first pivotal axis, an open operational state is defined as said first and second arcuate elements being moved apart from one another about said first pivotal axis to be able to clear the article and a closed operational state is defined as said first and second arcuate elements being moved toward one another about said first pivotal axis to cause a compressive force upon the article, said closed state is initially effectuated by variably manually compressing said first and second arcuate elements toward one another as against the article via said first pivotal movement to cause the compressive force upon the article, wherein said first and second arcuate elements can be in said closed state at a variable distance apart from one another to accommodate different size articles; and (c) a flexible retention arch beam having a free arched state with a free arched axis, a de-arched state with a de-arched state axis, and an intermediate arched state with an intermediate arched state axis, said flexible retention arch beam having a flexible retention arch beam proximal portion and an opposing flexible retention arch beam distal portion, said flexible retention arch beam proximal portion and said second distal portion have a second pivotal connection to one another about a second pivotal axis for a second pivotal movement, wherein said second pivotal axis and said first pivotal axis are substantially parallel to one another, said flexible retention arch beam distal portion having an adjustable interlocking section that has a plurality of interlocking points along said intermediate arched state axis, wherein said adjustable interlocking section is a serrated toothed rack having a pitch line that is substantially linear, said serrated toothed rack pitch line forming a tangential relationship with said arcuate pitch line at said interlock, wherein said serrated toothed rack is formed from a plurality of teeth that each have an equal pitch distance to one another and an equal whole depth as measured from a tooth tip to a tooth root, and an angle as between each tooth flank that progressively increases for each tooth in going from adjacent to said flexible retention arch beam proximal portion to said flexible retention arch beam distal end portion, resulting in each tooth having a short dimension tooth flank from a root pitch line to a tip pitch line and a long dimension tooth flank from said root pitch line to said tip pitch line, wherein each of said short and long dimensions of said tooth flanks both progressively increase for each tooth in going from adjacent to said flexible retention arch beam proximal portion to said flexible retention arch beam distal end portion, as said interlock is defined as a removably engagable contact as between a single short distance tooth flank and a single short dimension tooth flank, said progressively increasing long dimension tooth flanks structurally accommodate an increasing projected length of said long tooth flank distance due to said first pivotal movement of said first and second arcuate elements moving apart from one another to facilitate a larger article, said adjustable interlocking section resulting in a variable removable engagement with said engagement segment forming an interlock as between said flexible retention arch beam and said first arcuate element, wherein said interlock places said first and second arcuate elements in said closed state, wherein said flexible retention arch beam is in said intermediate arched state, when said first and second arcuate elements are in the closed state about the article, thus putting said first and second arcuate elements in place to cause said compressive force via said flexible retention arch beam trying to achieve said free arched state by pulling said second pivotal connection toward said interlock, said de-arched state is effectuated by manually compressibly grasping as between said flexible retention arch beam and being adjacent to said first pivotal connection to cause said flexible retention arch beam to go from said free arched state to said de-arched state to facilitate said interlock to occur, at which point the manual compressible grasp is released, wherein said flexible retention arch beam progresses to said intermediate arched state to cause the compression force upon the article from said first and second arcuate elements in said closed state.

2. A compression collar apparatus according to claim 1 wherein said flexible retention arch beam distal portion further includes a structural finger depression positioned adjacent to said adjustable interlocking section, wherein operationally manually inserting a finger into said structural finger depression and pushing the finger away from said interlock to cause said flexible retention arch beam to go to said de-arched state from said intermediate arched state, thus going to said free arched state when disengaging said interlock to allow said first and second arcuate elements to go from said closed state to said open state and releasing said compressive force on the article.

3. A compression collar apparatus according to claim 1 wherein said flexible retention arch beam has a stiffness for movement as between said free arched state, intermediate arched state, and de-arched state, wherein said stiffness is measured in a plane that is defined via said second pivotal movement as between said second pivotal axis and said adjustable interlocking section with said stiffness being in the range of about one-thousand pounds per inch to create said compressive force while said flexible retention arch beam is in said intermediate arched state.

4. A compression collar apparatus according to claim 3, wherein said flexible retention arch beam is constructed of nylon.

5. A compression collar apparatus according to claim 1, wherein said first and second arcuate elements each further include an inner surface wherein is disposed an elastomeric rib that is intersticed as between said inner surface and the article when said first and second arcuate elements are in said closed state, being operational to further enhance the grip from the compressive force upon the article from said first and second arcuate elements.

6. A compression collar apparatus comprising:

(a) a baseball bat having an axial longitudinal axis;

(b) a first arcuate element having a first arcuate axis, said first arcuate element having a first proximal portion and an opposing first distal portion, said first distal portion including an engagement segment that has a plurality of engagement points disposed along said first arcuate axis;

(b) a second arcuate element having a second arcuate axis, said second arcuate element having a second proximal portion and an opposing second distal portion, said first proximal portion and said second proximal portion have a first pivotal connection to one another about a first pivotal axis for a first pivotal movement, wherein said first pivotal axis and said longitudinal axis are substantially parallel to one another, wherein said first pivotal movement is positioned in a plane that is substantially perpendicular to said first pivotal axis, an open operational state is defined as said first and second arcuate elements being moved apart from one another about said first pivotal axis to be able to clear around said baseball bat and a closed operational state is defined as said first and second arcuate elements being moved toward one another about said first pivotal axis to cause a compressive force upon said baseball bat thus providing an axially adjustable axial stop on said baseball bat for a more secure manual grasp of said baseball bat, said closed state is initially effectuated by variably manually compressing said first and second arcuate elements toward one another as against said baseball bat via said first pivotal movement to cause the compressive force upon the baseball bat, wherein said first and second arcuate elements can be in said closed state at a variable distance apart from one another to accommodate various baseball bat diameters; and (c) a flexible retention arch beam having a free arched state with a free arched axis, a de-arched state with a de-arched state axis, and an intermediate arched state with an intermediate arched state axis, said flexible retention arch beam having a flexible retention arch beam proximal portion and an opposing flexible retention arch beam distal portion, said flexible retention arch beam proximal portion and said second distal portion have a second pivotal connection to one another about a second pivotal axis for a second pivotal movement, wherein said second pivotal axis and said first pivotal axis are substantially parallel to one another, said flexible retention arch beam distal portion having an adjustable interlocking section that has a plurality of interlocking points along said intermediate arched state axis, resulting in a variable removable engagement with said engagement segment forming an interlock as between said flexible retention arch beam and said first arcuate element, wherein said interlock places said first and second arcuate elements in said closed state, wherein said flexible retention arch beam is in said intermediate arched state when said first and second arcuate elements are in the closed state about the article, thus putting said first and second arcuate elements in place to cause said compressive force via said flexible retention arch beam trying to achieve said free arched state by pulling said second pivotal connection toward said interlock, said de-arched state is effectuated by manually compressibly grasping as between said flexible retention arch beam and being adjacent to said first pivotal connection to cause said flexible retention arch beam to go from said free arched state to said de-arched state to facilitate said interlock to occur, at which point the manual compressible grasp is released, wherein said flexible retention arch beam progresses to said intermediate arched state to cause the compression force upon the article from said first and second arcuate elements in said closed state.

7. A compression collar apparatus according to claim 6 wherein said flexible retention arch beam distal portion further includes a structural finger depression positioned adjacent to said adjustable interlocking section, wherein operationally manually inserting a finger into said structural finger depression and pushing the finger away from said interlock to cause said flexible retention arch beam to go to said de-arched state from said intermediate arched state, thus going to said free arched state when disengaging said interlock to allow said first and second arcuate elements to go from said closed state to said open state and releasing said compressive force on said baseball bat.

8. A compression collar apparatus according to claim 6 wherein said engagement segment is a serrated ratchet toothed segment having an arcuate pitch line that is substantially parallel to said first arcuate axis.

9. A compression collar apparatus according to claim 8 wherein said serrated ratchet toothed segment is formed from a plurality of teeth that each have an equal arcuate pitch distance to one another, a minor diameter segment root angle that is greater that a major diameter segment tip angle, resulting in a short distance tooth flank from said minor diameter segment to said major diameter segment and a long distance tooth flank from said minor diameter segment to said major diameter segment for each tooth.

10. A compression collar apparatus according to claim 9 wherein said adjustable interlocking section is a serrated toothed rack having a pitch line that is substantially linear, said serrated toothed rack pitch line forming a tangential relationship with said arcuate pitch line at said interlock.

11. A compression collar apparatus according to claim 10 wherein said serrated toothed rack is formed from a plurality of teeth that each have an equal pitch distance to one another and an equal whole depth as measured from a tooth tip to a tooth root, and an angle as between each tooth flank that progressively increases for each tooth in going from adjacent to said flexible retention arch beam proximal portion to said flexible retention arch beam distal end portion, resulting in each tooth having a short dimension tooth flank from a root pitch line to a tip pitch line and a long dimension tooth flank from said root pitch line to said tip pitch line, wherein each of said short and long dimensions of said tooth flanks both progressively increase for each tooth in going from adjacent to said flexible retention arch beam proximal portion to said flexible retention arch beam distal end portion, as said interlock is defined as a removably engagable contact as between a single short distance tooth flank and a single short dimension tooth flank, said progressively increasing long dimension tooth flanks structurally accommodate an increasing projected length of said long tooth flank distance due to said first pivotal movement of said first and second arcuate elements moving apart from one another to facilitate a larger diameter baseball bat.

12. A compression collar apparatus according to claim 6 wherein said flexible retention arch beam has a stiffness for movement as between said free arched state, intermediate arched state, and de-arched state, wherein said stiffness is measured in a plane that is defined via said second pivotal movement as between said second pivotal axis and said adjustable interlocking section with said stiffness being in the range of about 1,000 pounds per inch to create said compressive force while said flexible retention arch beam is in said intermediate arched state.

13. A compression collar apparatus according to claim 12, wherein said flexible retention arch beam is constructed of nylon.

14. A compression collar apparatus according to claim 6, wherein said first and second arcuate elements each further include an inner surface wherein is disposed an elastomeric rib that is intersticed as between said inner surface and said baseball bat when said first and second arcuate elements are in said closed state.

* * * * *